US010519632B2

(12) United States Patent
Campomanes et al.

(10) Patent No.: US 10,519,632 B2
(45) Date of Patent: Dec. 31, 2019

(54) SHROUD INSERT ASSEMBLY USING A RESILIENT MEMBER

(71) Applicant: Caterpillar Inc., Peoria, IL (US)

(72) Inventors: Patrick Simon Campomanes, Washington, IL (US); Amit Panjabrao Wankhade, Peoria, IL (US); Pradeep Chapagain, Peoria Heights, IL (US); Sunil I. Mathew, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 579 days.

(21) Appl. No.: 15/154,369

(22) Filed: May 13, 2016

(65) Prior Publication Data

US 2017/0328038 A1 Nov. 16, 2017

(51) Int. Cl.
*E02F 9/28* (2006.01)

(52) U.S. Cl.
CPC ..... *E02F 9/2883* (2013.01); *E02F 9/2825* (2013.01); *E02F 9/2858* (2013.01)

(58) Field of Classification Search
CPC ..... E02F 9/2883; E02F 9/2816; E02F 9/2825; E02F 9/2833; E02F 9/2841
See application file for complete search history.

(56) References Cited

U.S. PATENT DOCUMENTS 3,137,352 A * 6/1964 Petersen ..... E02F 9/2825 172/713
5,016,365 A 5/1991 Robinson
5,526,592 A 6/1996 Bierwith
5,553,409 A 9/1996 Irving
5,713,145 A 2/1998 Ruvang
6,151,812 A 11/2000 Bierwith
6,216,368 B1 * 4/2001 Bierwith ..... E02F 9/2825 37/457
6,751,897 B2 6/2004 Bierwith
6,986,216 B2 1/2006 Emrich et al.
7,032,334 B2 4/2006 Pippins
7,080,470 B2 7/2006 Jones
7,299,570 B2 11/2007 Emrich et al.
7,559,162 B2 7/2009 Bierwith
7,730,645 B2 6/2010 Ollinger, IV
7,793,444 B2 9/2010 Jones et al.
8,024,874 B2 9/2011 McClanahan et al.
8,819,967 B2 9/2014 Campomanes
8,925,220 B2 1/2015 Stangeland et al.
8,943,717 B2 2/2015 Renski et al.
(Continued)

FOREIGN PATENT DOCUMENTS

AU 2011226948 A1 10/2011
WO WO2007016719 A1 2/2007
WO WO2007079527 A1 7/2007

*Primary Examiner* — Jessica H Lutz
(74) *Attorney, Agent, or Firm* — Law Office of Kurt J. Fugman LLC

(57) ABSTRACT

A support member for use with a support assembly for ground engaging tools comprises a structural member; and a resilient member that includes a base, and a contact surface, and wherein the structural member defines a direction of assembly and the resilient member defines a length and a width that are perpendicular to each other and to the direction of assembly, wherein the length exceeds the width and the base defines a centerline that is parallel to the length, and the contact face defines a centerline that is parallel to the length.

14 Claims, 20 Drawing Sheets

(56) References Cited

U.S. PATENT DOCUMENTS

| | | | | |
|---|---|---|---|---|
| 9,057,177 | B2 | 6/2015 | Renski et al. | |
| 2005/0229442 | A1* | 10/2005 | Jones | E02F 9/2825 37/452 |
| 2008/0005940 | A1 | 1/2008 | Ollinger | |
| 2008/0092412 | A1* | 4/2008 | McClanahan | E02F 9/2841 37/451 |
| 2008/0092413 | A1* | 4/2008 | McClanahan | E02F 9/2841 37/451 |
| 2008/0216365 | A1 | 9/2008 | Terveer | |
| 2014/0360060 | A1 | 12/2014 | Kunz | |
| 2015/0197921 | A1 | 7/2015 | Campomanes | |
| 2015/0247306 | A1 | 9/2015 | Kunz | |
| 2017/0058491 | A1* | 3/2017 | Kunz | E02F 9/2858 |

* cited by examiner

SHROUD INSERT ASSEMBLY USING A RESILIENT MEMBER

TECHNICAL FIELD

The present disclosure relates to the field of machines that perform work on a material using work implements such as earth moving machines and the like. Specifically, the present disclosure relates to support systems for ground engaging tools and tool adapters that are attached to work implements used on such machines.

BACKGROUND

During normal use on machines such as mining machines including electric rope shovels, ground engaging tool adapters may experience stresses in their legs that straddle the lips of excavating buckets and the like. It is not uncommon for these components to see extremely high loads due to severe operating or material conditions. Consequently, the lips of the buckets may become worn over time due to slippage of components such as the tool adapter that ride on this edge. This can lead to undesirable maintenance for the machine while these parts are replaced.

SUMMARY OF THE DISCLOSURE

A shroud insert assembly for use with a support assembly for ground engaging tools is provided. The shroud insert assembly comprises a shroud insert comprising: a throat portion that defines a recess that defines a longitudinal axis and a direction of assembly for the shroud insert that are coextensive; a first upper leg; a first lower leg; and a first support portion that includes a support surface that defines a surface normal pointing toward the front of the shroud insert along the direction of assembly that forms an oblique angle with the direction of assembly; and a support member that is attached to the support surface comprising: a resilient member.

A shroud insert for use with a support assembly for ground engaging tools is provided. The shroud insert comprises a throat portion that defines a recess that defines a longitudinal axis and a direction of assembly for the shroud insert that are coextensive; a first upper leg; a first lower leg; and a first support portion that includes a support surface that defines a surface normal pointing toward the front of the shroud insert along the direction of assembly that forms an oblique angle with the direction of assembly.

A support member for use with a support assembly for ground engaging tools is provided. The support member comprises a structural member; and a resilient member that includes a base, and a contact surface, and wherein the structural member defines a direction of assembly and the resilient member defines a length and a width that are perpendicular to each other and to the direction of assembly, wherein the length exceeds the width and the base defines a centerline that is parallel to the length, and the contact face defines a centerline that is parallel to the length.

BRIEF DESCRIPTION OF THE DRAWINGS

FIG. 28 is a top view of an embodiment of the shroud insert, support member and resilient member of the present disclosure while

FIG. 33 is a front view of the support member and resilient member of FIG. 28 while

FIG. 35 is a top view of the support member and resilient member of FIG. 34 while

DETAILED DESCRIPTION

Figure 1:
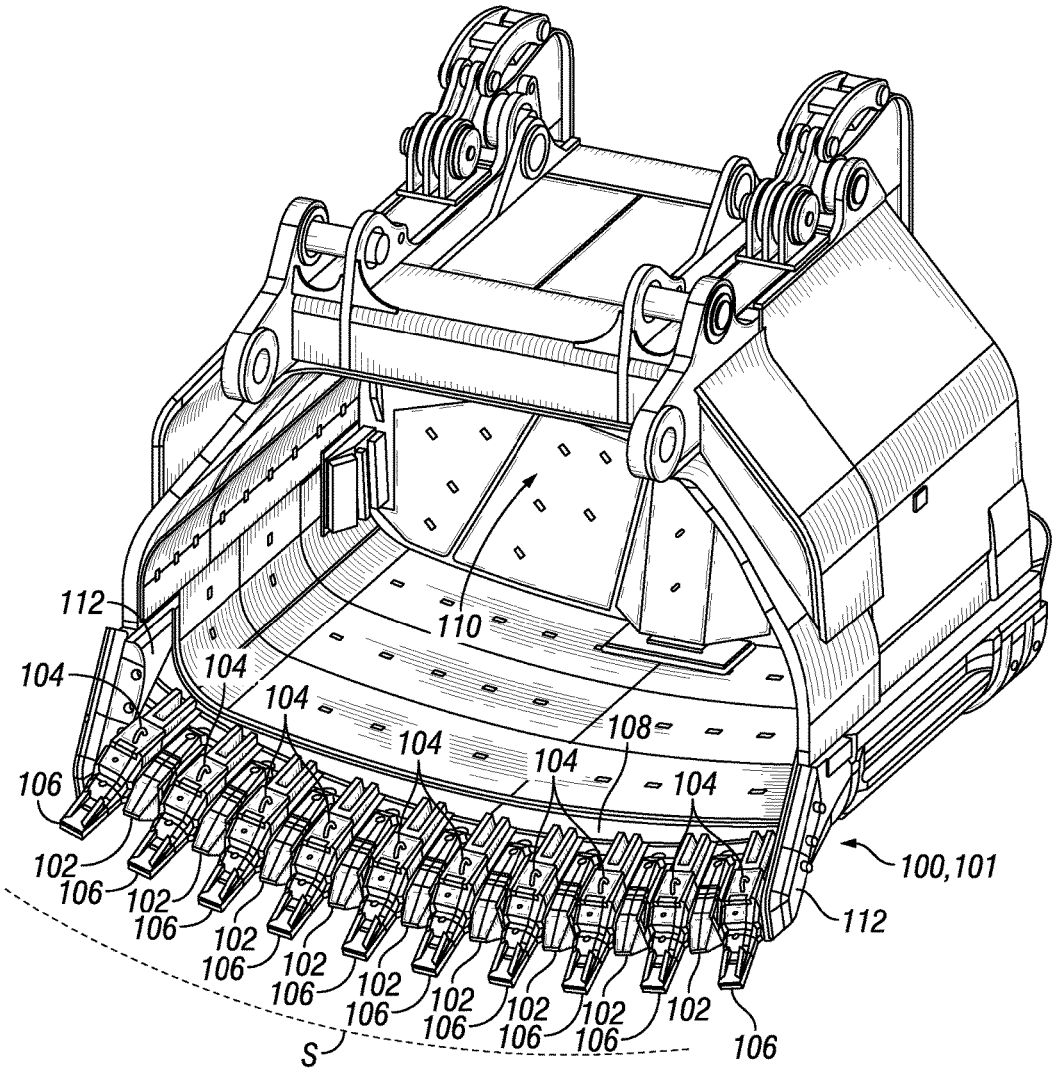
FIG. 1 is a perspective view of a work implement in the form of a bucket that has a front lip with shroud or lip protectors, tool adapters and teeth attached to the lip that provide support one for another according to one embodiment of the present disclosure.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100a, 100b or a prime indicator such as 100', 100" etc. It is to be understood that the use of letters or primes immediately after a reference number indicates that these features are similarly shaped and have similar function as is often the case when geometry is mirrored about a plane of symmetry. For ease of explanation in this specification, letters or primes will often not be included herein but may be shown in the drawings to indicate duplications of features discussed within this written specification.

Looking at FIG. 1, a work implement 100 in the form of an excavating bucket 101 is shown that has a series of alternating lip shroud protectors 102 and tool adapters 104 with tools 106 attached to the front lip 108. Although it cannot be clearly seen in this figure, the tool adapters 104 and the shroud protectors 102 are operatively connected to each other to provide support to each other along the sweep direction S of the front lip 108, which is curved in the horizontal and vertical planes as will be discussed shortly. Consequently, the sweep direction will be designated with "S" to represent the curvature of the sweep axis in a horizontal plane (see FIG. 2), while the sweep direction will be designated "S'" to represent the curvature of the sweep axis in a vertical plane (see FIG. 3).

For this embodiment, the shroud protector 102 is coupled to the front lip 108 using a method and device well known-in-the-art and sold under the TRADENAME of CAPSURE by the assignee of the present application. This same device and method is used to secure the tools 106 to the tool adapters 104 as will be more clearly explained later herein. The tool adapters 104 are attached to the front lip 108 using a wedge and spool retaining system as will also be better described later herein. The methods of any attachment may be varied as needed or desired. The interior 110 of the bucket 101 is configured to receive a work material such as dirt, rock and the like that is broken up by the tools 106 attached to the bucket 101. The shroud protectors 102 help protect the front lip 108 from damage during the shoveling process.

Figure 2:
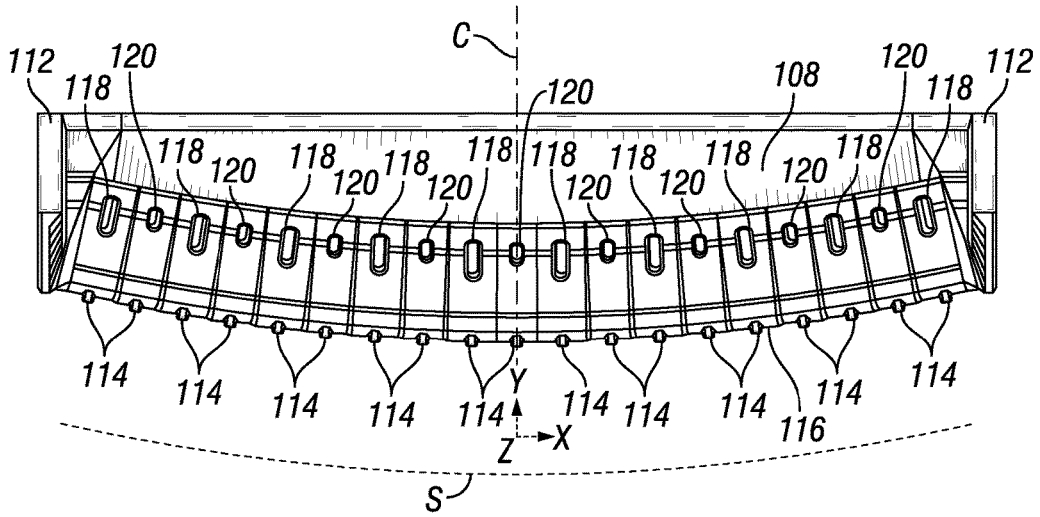
FIG. 2 is a top view of the front lip of the bucket of FIG. 1 shown in isolation showing its curvature in a horizontal or X-Y plane.

FIG. 2 is a top view of the front lip 108 shown in isolation from the bucket assembly showing the curvature that is represented by the sweep direction S, which is a curve offset from the theoretical shape of the front edge 116. For this embodiment, the front lip 108 is an integrally cast member that includes wings 112 on either side but the configuration, material and method of manufacture for the front lip may be varied as needed or desired. A Cartesian coordinate system is provided where the X-Y plane represents a horizontal plane relative to the ground and the X-Z plane and Y-Z plane represent vertical planes relative to the ground. Of course, the relative positions of the ground to the Cartesian coordinate system, which is fixed relative to the bucket, may change depending on the orientation of the bucket in use.

The origin and Y axis are aligned on the centerline plane C of the lip 108 and the Y-Z plane represents a plane of symmetry for the front lip 108. As can be seen, the sweep direction S is curved in the X-Y plane. A plurality of lip protrusions 114 extend from the front edge 116 of the lip 108 in a generally perpendicular direction to the sweep direction S that are used to center the shroud protectors 102 in a manner that will be more fully described later herein. An alternating pattern of long and short elongated locking apertures 118, 120 (which correspond to alternating positions for the shroud protector 102 and the tools 106 not shown in this figure) are provided along the sweep direction S that extend completely through the front lip 108. The short elongated locking apertures 120 are used to attached the shroud protectors 102 while the long elongated locking apertures 116 are used to attached the tool adapters 104 by providing a locking post (not shown) disposed therein. As just mentioned, different mechanisms are used for these attachments but the type of attachments may be varied as needed or desired. Any of these features discussed with respect to FIG. 2 may be changed or omitted in other embodiments of the present disclosure.

Figure 3:
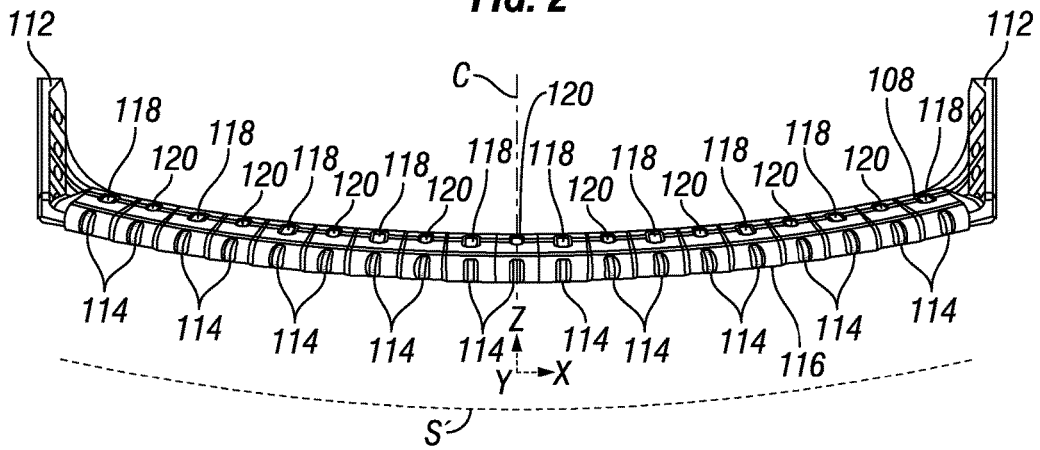
FIG. 3 is front view of the lip of FIG. 2 showing its curvature in a vertical or X-Z plane.
Figure 4:
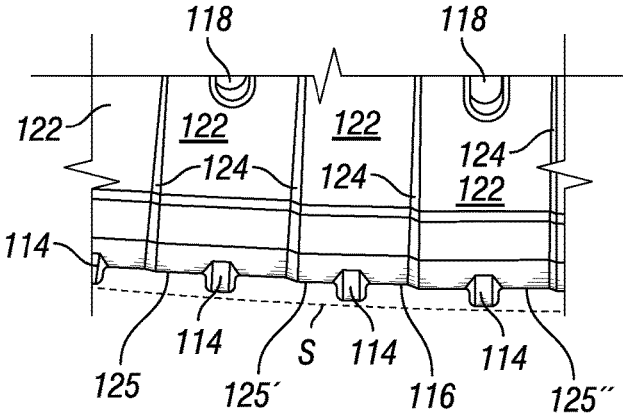
FIG. 4 is an enlarged top view of the lip of FIG. 2 showing segments that compensate for the curvatures of the front lip and also showing mounting apertures and lip protrusions.

FIG. 3 is a front view of the lip 108 that shows the lip protrusions 114, wings 112, short elongated locking apertures 120, and long elongated locking apertures 118 of the lip 108. It also shows that the sweep direction S of the front lip 108 is curved in the vertical X-Z plane as shown. As shown by FIG. 4, due to the three dimensional curvature of the sweep direction S, S' of the front lip 108, discrete segments 122 are provided along the sweep direction S, S' of the front lip 108 with transition regions or steps 124 that help to maintain areas of substantially similar configuration to each other, which facilitates the repeated use of similarly configured components along the sweep direction S of the front lip 108. More specifically, each segment has a straight front edge 125 and consistent configurations for the top and bottom surfaces for each adjacent segment.

Figure 5:
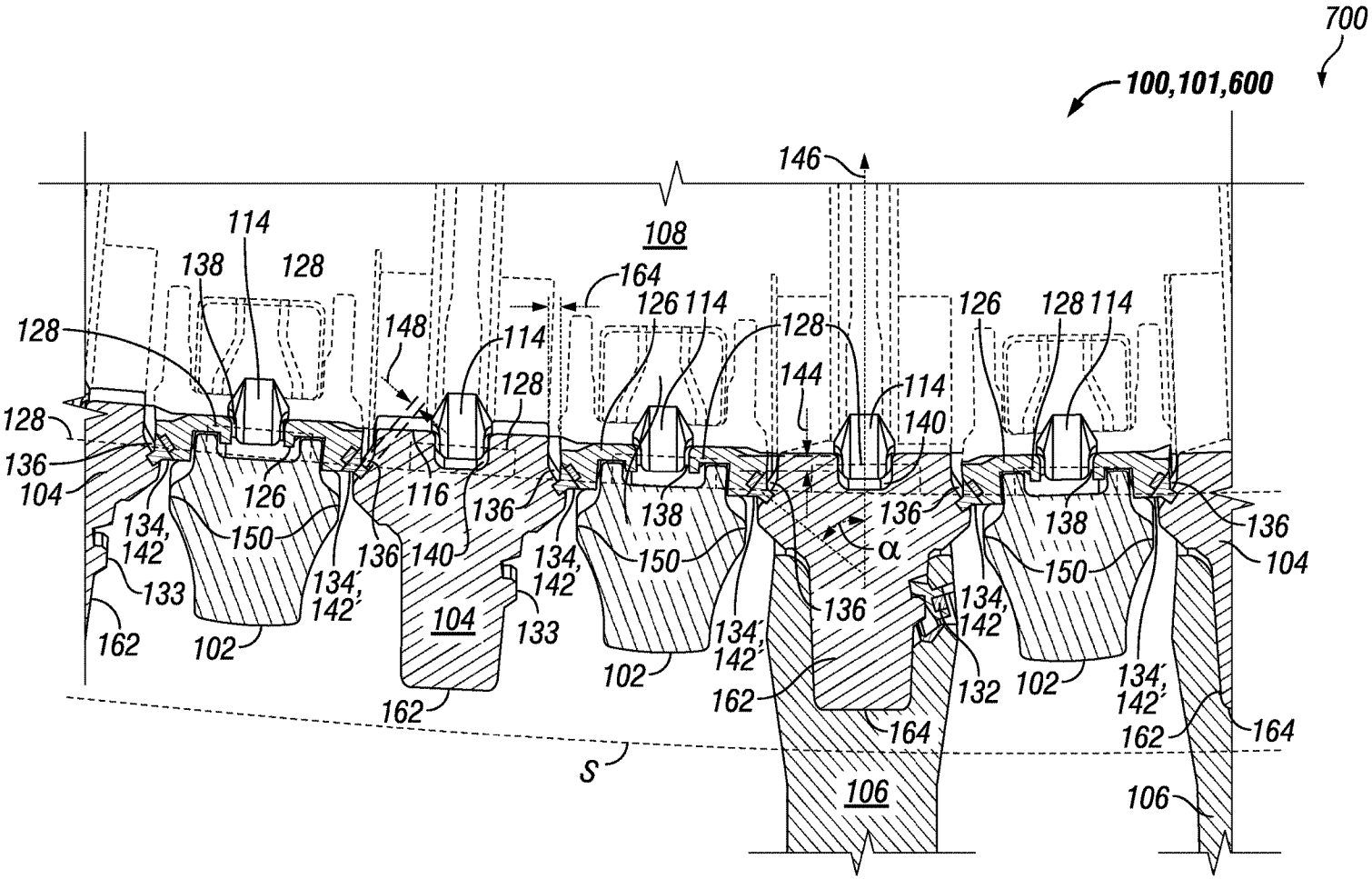
FIG. 5 is an enlarged top view of the bucket of FIG. 1 showing the shroud protectors, shroud inserts, tool and tool adapters in cross-section, more clearly showing the structural support that the shroud inserts provide to the tool adapters and vice versa.

Focusing now on FIG. 5, it is an enlarged top view of the bucket 101 of FIG. 1 showing the shroud protectors 102, shroud inserts 126, tool 106 and tool adapters 104 in cross-section, also more clearly showing the structural support that the shroud inserts 126 provide to the tool adapters 104 and vice versa. Exemplary load paths 128 are shown that extend from a tool 106 to an adjacent shroud insert 126 or a shroud protector 102 through a tool adapter 104. These load paths 128 may continue from one adjacent tool or tool adapter to another adjacent member that is attached to the front lip or other working edge 116 of a bucket 101 or other work implement 100 such as a rake, shears, etc. along the sweep direction S of the front edge 116.

For the embodiment specifically shown in FIG. 5, there is an alternating series of shroud protectors 102 that are attached to the front lip 108 and tools 106 that are attached to the front lip 108 along the sweep direction S of the front lip 108. The shroud protectors 102 may interface with the shroud insert 126 that may be separately attached to the front lip 108 or the shroud insert 126 may be held onto the front lip 108 using solely the retaining mechanism 130 (not shown in FIG. 5 but shown in FIG. 7) of the shroud protector 102. In this embodiment, the shroud insert 126 may also be held onto the front lip 108 by a tool adapter 104 that is directly attached to the front lip 108 without needed the shroud protector. The tools 106 may be attached directly to the front lip 108 or it could be attached to a tool adapter 104 using a mechanism 132 as previously described while the tool adapter 104 may be attached to the front lip using a retaining mechanism 172 as previously described and best seen in FIG. 8. In particular, a boss 133 may be provided on the tool adapter 104 that is used with a retaining mechanism 132 housed in the tool 106 itself for retaining the tool 106 onto the tool adapter 104.

The shroud insert 126 is shown to include a support member 134 that is configured to contact or abut a reinforcement surface 136 of the tool, or as is the case with this embodiment, the tool adapter 104. This provides a load path 128 such that forces that are exerted on the tool 106 will be transferred through the support member 134 and to the shroud insert 126. This load path 128 may then pass through the shroud insert 126 to the other support member 134' that contacts the other adjacent tool adapter 104 along the sweep direction S of the front lip 108. The load path 128 may extend all the way from one end of the bucket 101 or other work implement 100 to the other end along the sweep direction S of the lip 108 or other edge of the work implement or only partially along the sweep axis S depending on the configuration and number of components that are employed.

Similarly, this same load path 128 may work in the opposite direction such that forces exerted on the shroud protector 102 are transferred through the shroud insert 126 and the support member 134 to an adjacent member such as a tool adapter 104 or tool 106.

As shown via hidden lines, each shroud insert 126 and tool adapter 104 may have inner recesses 138, 140 respectively that are at least partially complimentary configured to the lip protrusions 114, helping to lock and center the tool adapter 104 and shroud insert 126 with respect to the lip protrusions 114 and the corresponding locking aperture 118, 120 (not clearly shown in FIG. 5 but shown in FIGS. 2 thru 4). These inner recesses may engage the lip protrusion, allowing loads exerted on the shroud insert or tool adapter to be transferred to the lip and limit movement.

For this embodiment, the support member 134 is a separate member from the shroud insert 126 and the shroud protector 102 and includes a resilient member 142 that contacts or abuts the reinforcement surface 136 of the tool adapter 104. In other embodiments, these components may be integral with each other. More specifically, the resilient member 142 extends a predetermined distance 144 away from the front edge 116 of the front lip 108 and at a non-parallel angle $\alpha$ to the assembly direction 146 of the tool adapter 106. The reinforcement surface 136 is substantially perpendicular to this angle $\alpha$. This angle may range as needed or desired but may be in the range of 50 to 75 degrees, and more particularly, from 55 to 65 degrees. The distance 144 may be any suitable distance greater than zero. However, it is contemplated that the resilient member may not extend in front of the front lip but may be substantially above or below this lip, or may even be located further toward the interior of the bucket or other work implement for other embodiments.

The amount the resilient member 142 extends from the shroud insert 126 toward the tool adapter 104 may exceed the physical gap between the shroud insert and the tool adapter once the tool adapter and shroud insert have been fully attached to the lip, forming an interference 148. The preload may be expressed as a dimensional interference that may vary as desired but may be 3 to 9 mm in some embodiments. The reinforcement surface 136 may be switched from the tool adapter 104 to the shroud insert 126 and the support member 134 may be switched from the shroud insert 126 to the tool adapter 104. The resilient member 142 may be made of rubber, polyurethane or another suitable material such as closed-cell foam. The resilient member could also be a spring.

Figure 9:
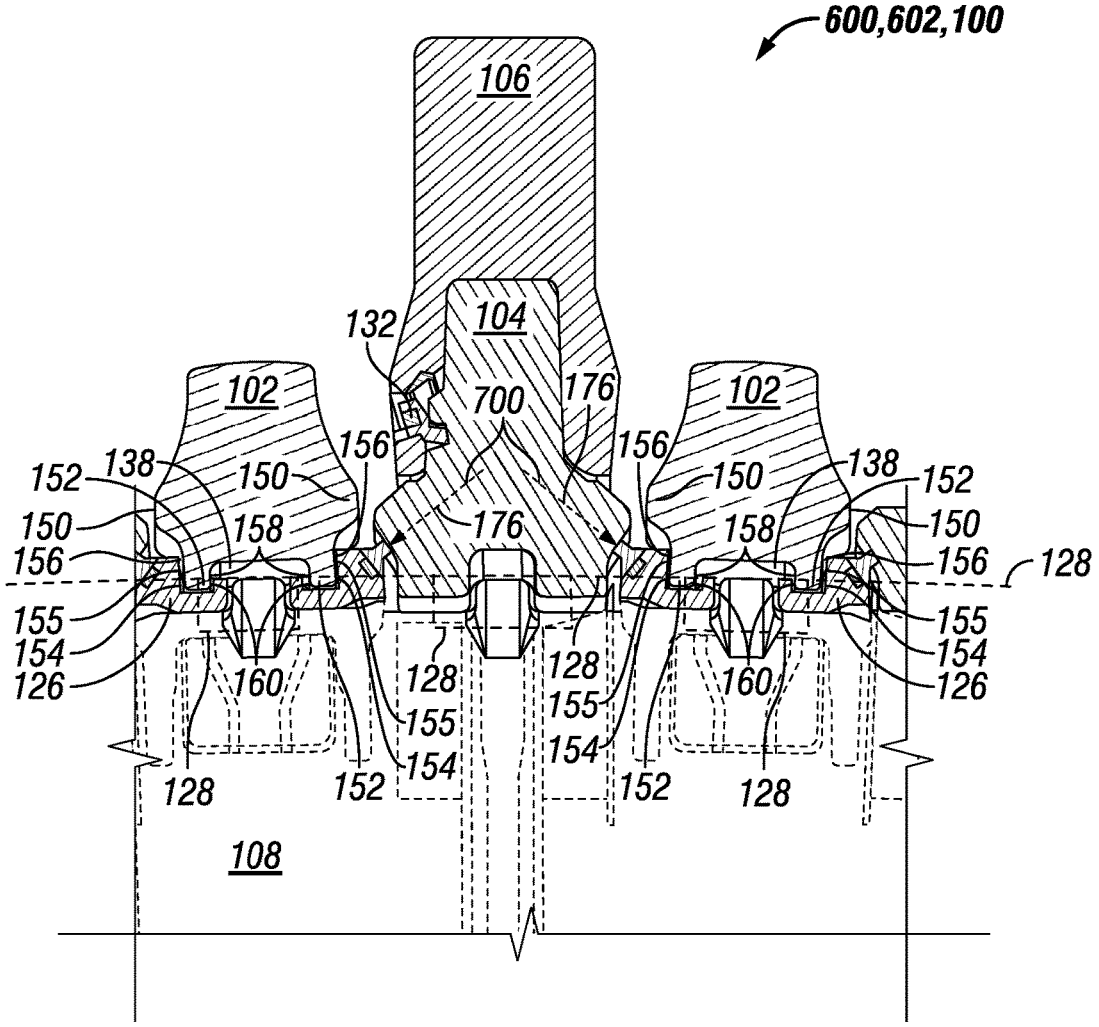
FIG. 9 is an enlarged bottom cross-sectional view showing more clearly how the shroud insert supports the tooth adapter and how the tooth is retained on the tooth adapter using a rotating locking member.

The shroud protector 102 also includes a protective feature 150 that shields the resilient member 142 from contact with work material, helping to increase its longevity. Also as best shown in FIG. 9, the shroud protector 102 includes mating features 152 in the form of two projections with outer surfaces 154 that contact the outer surfaces 155 of the outer locating recess 156 of the shroud insert 126. Conversely or in addition to this, the inner surfaces 158 of the projections may contact the inner surfaces 160 of the outer recess 156 of the shroud insert 126. This allows the shroud protector to engage the shroud insert to transfer loads exerted on the shroud protector to the shroud insert.

FIG. 5 also shows how the nose 162 of the tool adapter 104 fits into a complimentary shaped recess 164 of the tool 106, thereby providing support to the tool as it encounters various forces in use, effectively allowing the transfer of loads exerted on the tool to the adapter.

In general, any of the features described with reference to FIG. 5 may be switched from one component to another. In such a case, the corresponding feature on one component would also be switched to the other component.

Referring again to FIG. 5 in more general terms, the bucket 101 represents one example of a work implement 100 that includes a working edge 116, which may be located anywhere on the work implement and extend in any direction that defines a sweep direction S. A tool 106 is operatively connected to the working edge 116, meaning that it may be directly attached to the work implement or it may be connected via another component such as the tool adapter 104, etc. A support member 134 which may be the shroud insert 126 itself or a separate member that is attached to the shroud insert 126 or the shroud protector 102, etc., is operatively connected to the working edge 116 separately from the tool 106.

In other words, the support member 134 may be attached or detached independently from the tool 106. The support member 134 may be connected to the working edge 116 a predetermined distance 164 away from the tool 106 along the sweep direction S. The support member 134 may include a resilient member 142 and the tool 106 and the support member 134 may be operatively associated with each other and configured to provide a load path 128 through the resilient member between the tool and the support member. This load path may extend at least a portion of the sweep direction and may extend substantially along the entire sweep direction when an alternating pattern of properly configured support members and tools are placed along the entire working edge of the work implement. Distance 164 may be any suitable distance greater than zero.

In some embodiments, another dampener other than a resilient member such as a spring or another mechanical dampener may be employed. The dampener may be part of the support member and may be configured to absorb or dampen force. In other embodiments, no resilient member or other dampener may be used and the support member may have a solid or rigid interface with the tool or other component placed between the tool and the support member such as the tool adapter.

Taking a side force of on the adapter 104 will result in the adapter moving in the same direction. As the adapter moves, the insert 126 moves in the same directions via the resilient member 142 on the insert 126. The movement is stopped by the lip casting protrusion 114 in the lip shroud or shroud protector position and the opposite resilient member 142' pushing against the next adapter 104. Once this insert movement is stopped, the additional movement of the adapter will be applied to the resilient member and applying an opposing force back onto the adapter. The adapter movement is either stopped by the resilient member force, supplied by the interference 148, or contact of the adapter 104 on the lip casting protrusion 114 in the adapter position. The purpose of the resilient member 142 is also to absorb the shock load (impact) and dampen the force transferred from the adapter 104 to the lip 108.

Figure 6:
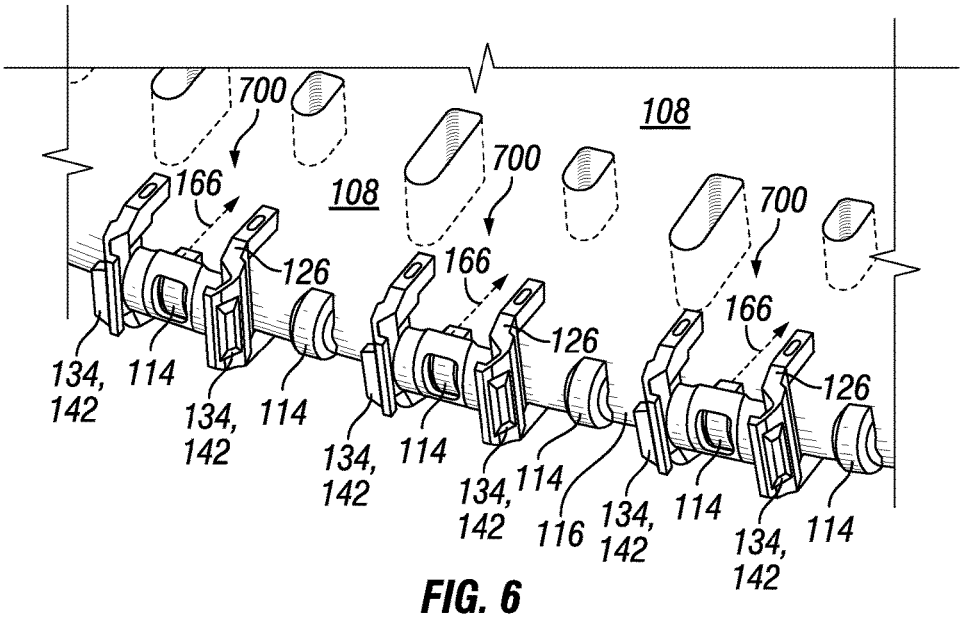
FIG. 6 is an enlarged perspective view of the shroud inserts of FIG. 5 shown placed onto the front lip before the shroud protector, tool adapters, or tools have been attached to the front lip.
Figure 7:
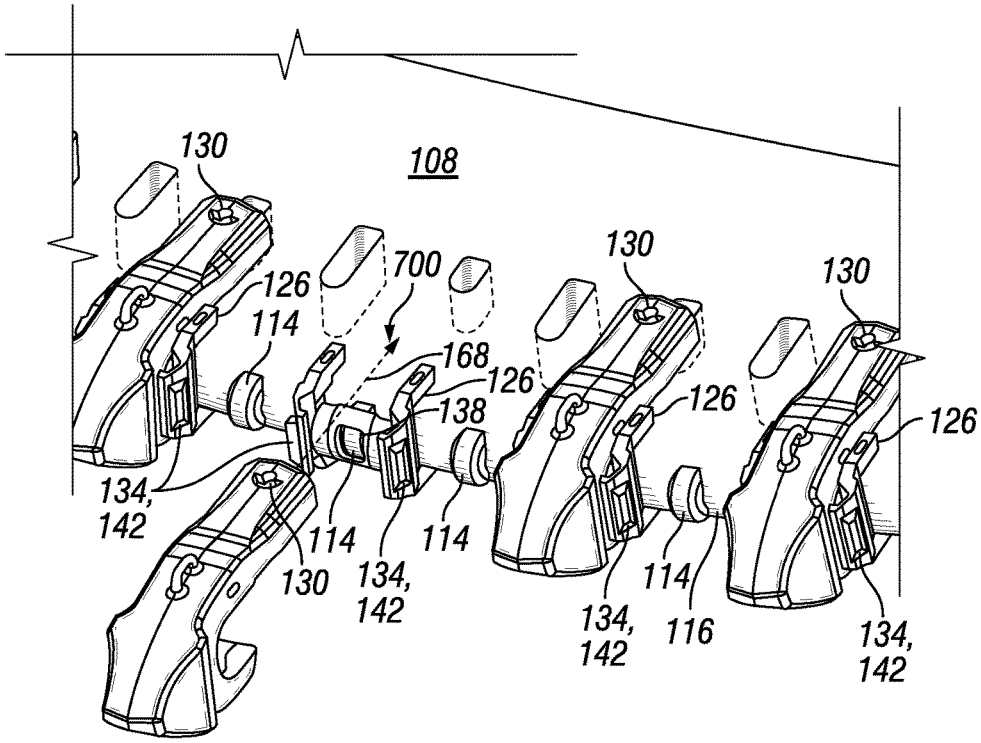
FIG. 7 illustrates the assembly of the shroud protector onto the front lip while mating and aligning with the shroud insert.

During installation as indicated by FIGS. 6 and 7, the insert casting 126 is installed (step 166 of FIG. 6) onto the lip shroud or shroud protector positions of the lip casting until the protrusions 114 are in the inner recess 138 of the insert 126 prior to installing the adapters 104. The lip shrouds or shroud protectors 102 are then installed and secured into place (step 168 of FIG. 7).

Figure 8:
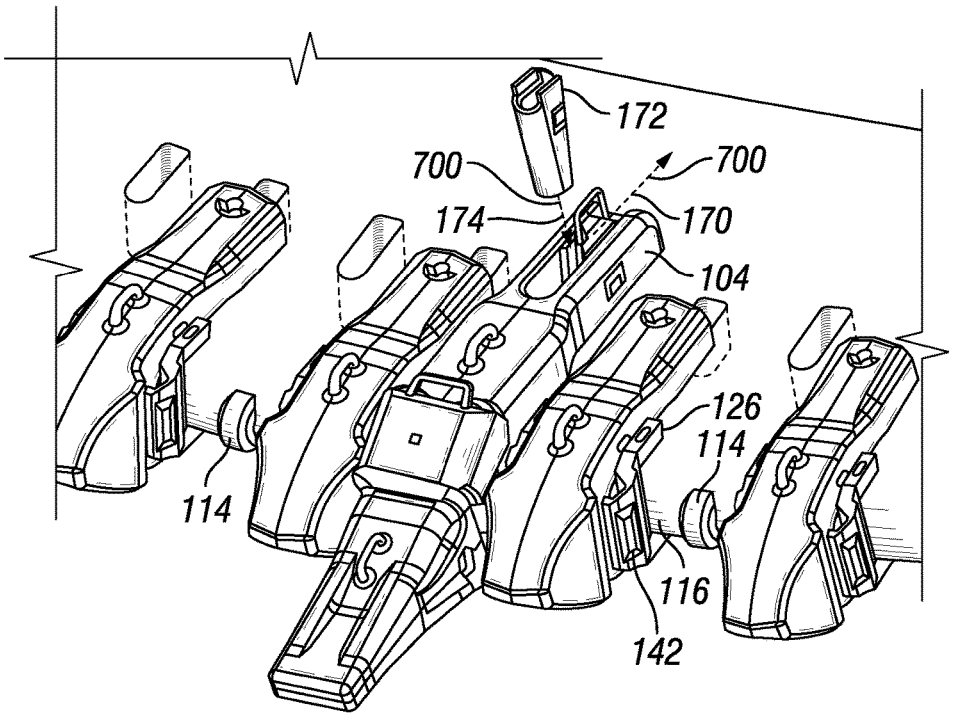
FIG. 8 illustrates the assembly of a tooth adapter onto the front lip using a retaining wedge.

Next as shown by FIG. 8, the adapters 104 are seated into the adapter positions until the adapter 104 makes contact with one of the resilient members 142 of the insert 126 (step 170). The adapter retention system 172 will then be installed and tightened (step 174). This tightening will compress the resilient members on the inserts and center the location of the adapter onto the adapter lip position using the protrusions 114. The adapter will stop moving when it makes contact with the lip casting radius or front edge 116.

As depicted by FIG. 9, when all the adapters 104 are installed, the resilient members 142 on the insert 126 are all compressed thus tying all the adapter and inserts together, forming the load path 128 (step 176).

Focusing now on the support member 134 and the shroud insert 126, FIGS. 10 thru 13 show various views of one embodiment of the support member 134 and shroud insert 126 of the present disclosure shown as a shroud insert assembly 178. As shown, the support member 134 and shroud insert 126 are separate components that may be loosely connected to each other, that may be fastened to each other, or that may be combined into a single component in other embodiments. For example, the support member 134 may include a resilient member 142 that may include a rubber material that is directly vulcanized to the shroud insert 126.

The shroud insert 126 includes a throat portion 200 that defines an inner recess 202, so-called as it is located toward the center of the shroud insert 126, that is at least partially complimentary to a lip protrusion 114 with which it mates. The throat portion 200 has a curved configuration with a curved outer surface 204 and a curved inner surface 206 that is configured to match the curvature of the front edge 116 of the lip 108 and that defines a lateral direction L. The inner recess 202 is shown to be centered laterally with respect to the body of the shroud insert 126 along the lateral direction L. The shroud insert 126 further comprises at least one upper leg 208 and at least one lower leg 210 that are configured to straddle the front lip 108 once the shroud insert 126 is installed on the front lip 108. These legs 208, 210 extend toward the rear of the shroud insert 126 along the direction of assembly 211, defined by the inner recess 202 and that is coextensive with the longitudinal axis 212 of the inner recess. The legs extend at a ninety degree angle to the throat portion 200 of the shroud insert 126 and are connected at the opposite ends of the throat portion 200.

Figure 10:
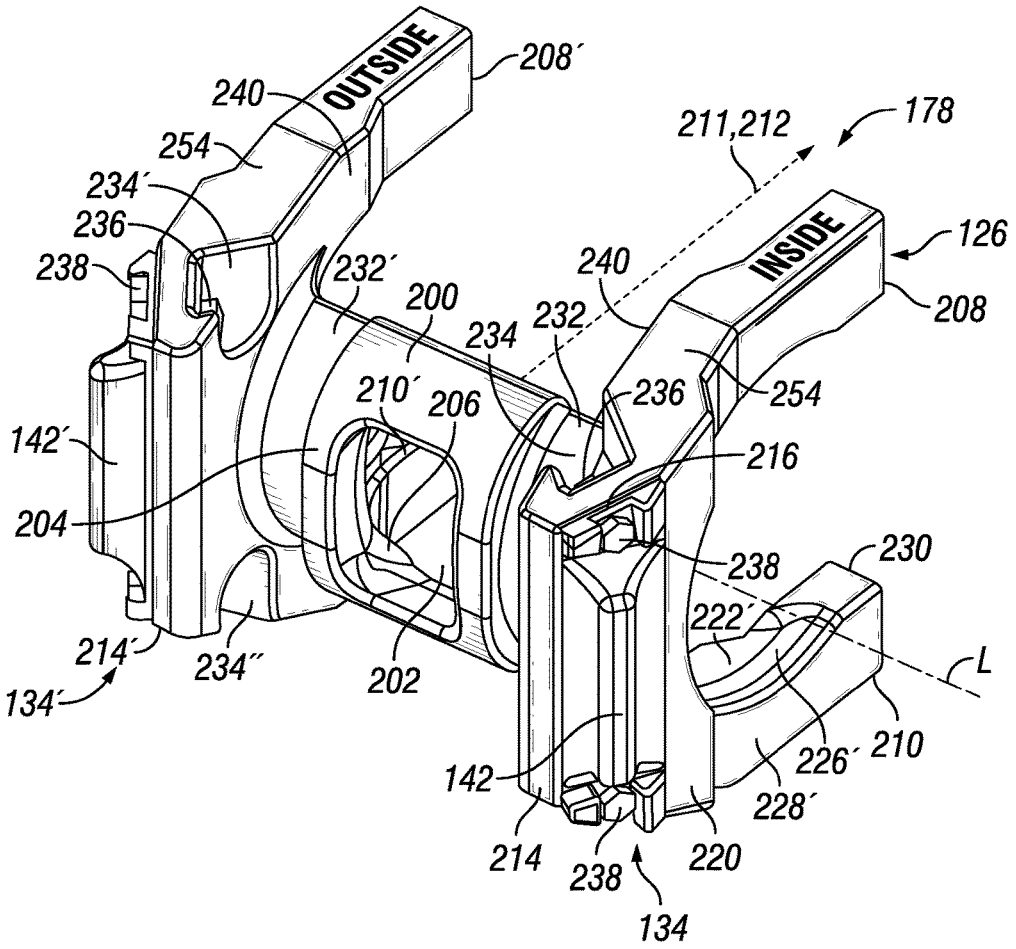
FIG. 10 is a perspective view of a shroud insert and support members that are assembled together according to one embodiment of the present disclosure.
Figure 13:
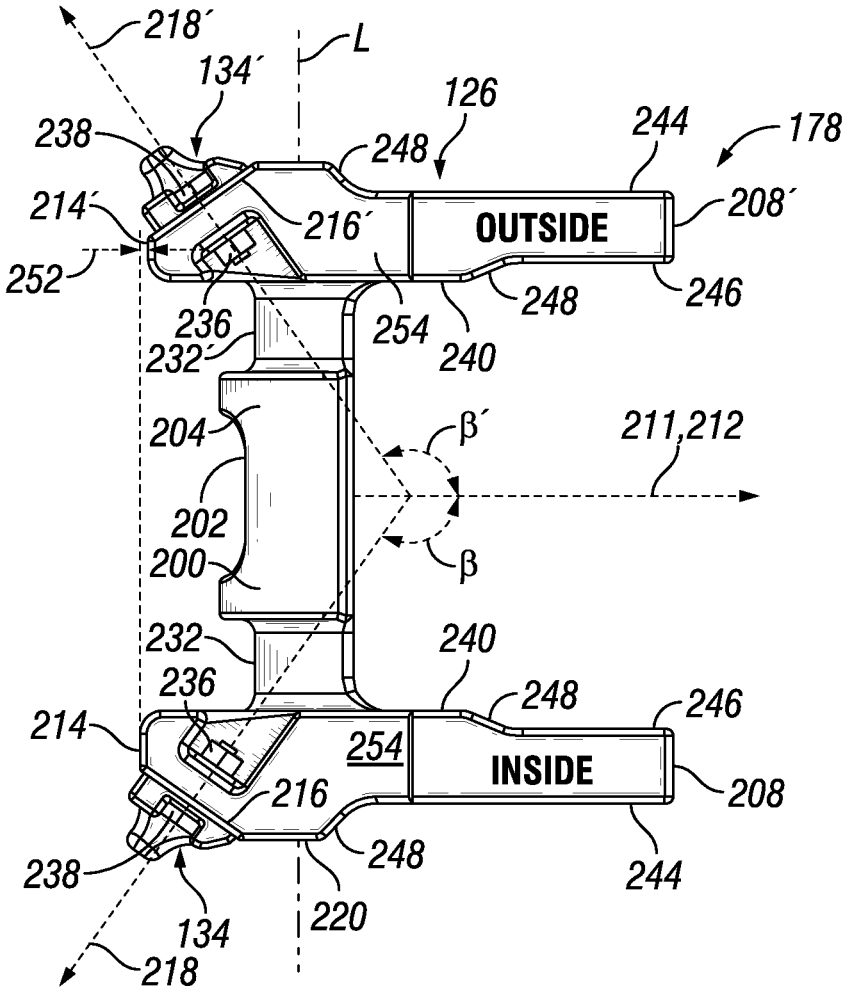
FIG. 13 is a top view of the shroud insert of FIG. 10.

As best seen in FIGS. 10 and 13, a first support portion 214 extends forward or toward the front of the throat portion 200 along the direction of assembly 211 approximately from the intersection of the upper leg 208 with the throat portion 200 to approximately the intersection of the lower leg 210 with the throat portion 200. As best seen in FIG. 13, the support portion 214 includes a support surface 216 that is configured to define a surface normal 218 that makes an oblique angle β with the direction of assembly 211 of the shroud insert 126. The inner recess 202, which for this embodiment is a thru-hole, may be a blind hole in other embodiments.

Figure 12:
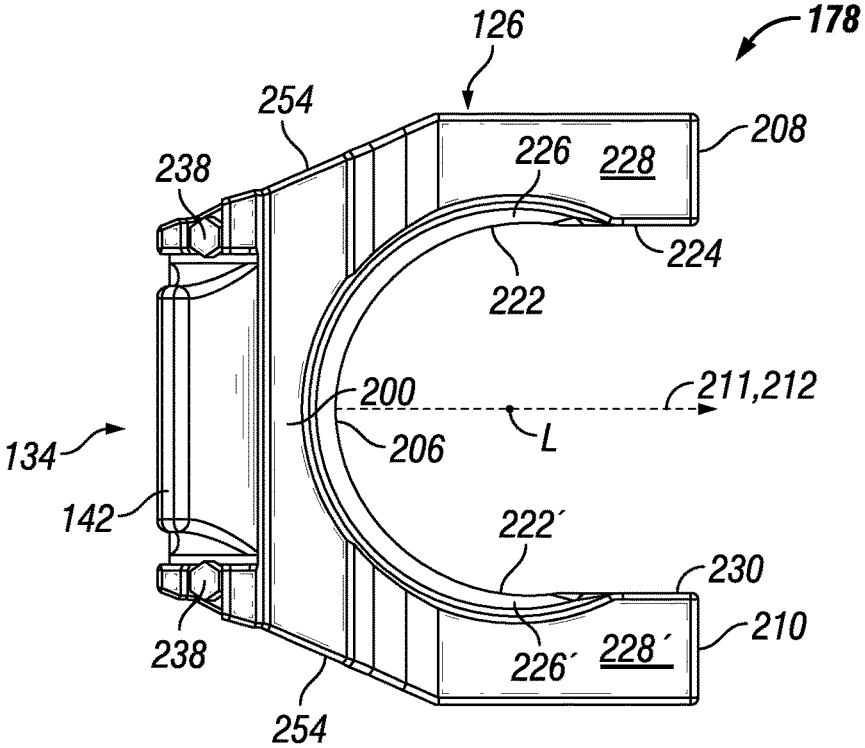
FIG. 12 is a side view of the shroud insert of FIG. 10.

For some embodiments, the angle β may range from 110 to 160 degrees but may vary as needed or desired. The support surface 216 may extend to a lateral extremity 220 of the shroud insert 126 measured in lateral direction L. For this embodiment as best seen in FIG. 12, the upper leg 208 has a curved surface 222 adjacent its lower surface 224 that is configured to match the contour of the front lip 108 and an angled surface 226 that is adjacent the curved surface 222 and joins the curved surface 222 to the side surface 228 of the leg 208 with the addition of some blends and provides clearance for the steps 124 of adjacent segments 122 of the lip 108. Similarly, the lower leg 210 has a curved surface 222' adjacent its top surface 230 that is configured to match the contour of the front lip and an angled surface 226' that is adjacent the curved surface 222' that joins the curved surface 222' to the side surface 228' of the leg 210 with the addition of some blends and provides clearance for the steps of the adjacent segments of the lip.

As shown in FIGS. 10 and 13, the shroud insert 126 further comprises a second upper leg 208' and a second lower leg 210' that are similarly configured as just described with respect to the first upper leg and first lower leg. Likewise, a second support portion 214' extends toward the front of the throat portion 200 approximately from the intersection of the second upper leg 208' with the throat portion 200 to approximately the intersection of the second lower leg 210' with the throat portion 200. As best seen in FIG. 13, the support portion 214' includes a support surface 216' that is configured to define a surface normal 218' that makes an oblique angle β with the direction of assembly 211 of the shroud insert 126. At least a portion of either support surface is positioned forward of the throat portion along the direction of assembly.

Figure 28:
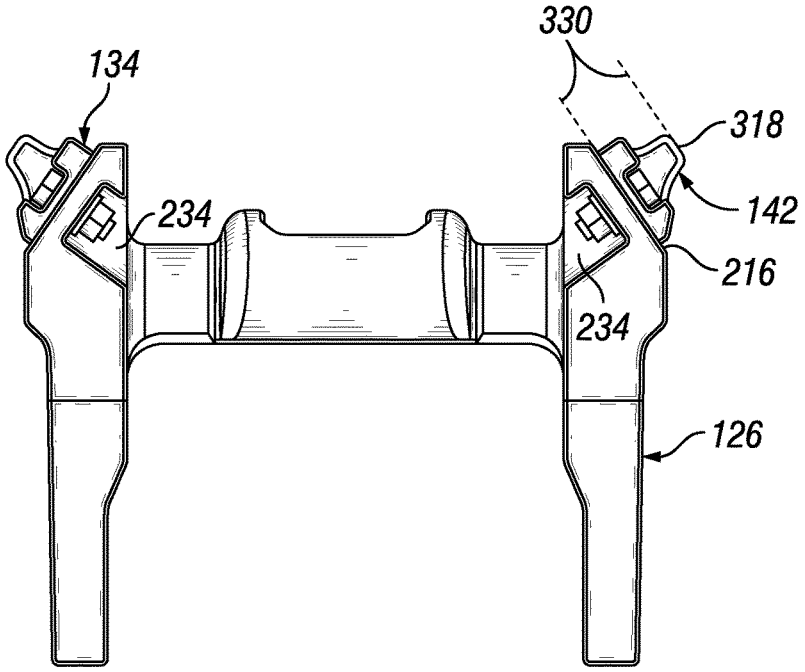

Although not shown clearly in FIGS. 10 thru 13, the support member 134 includes a projection 300 (see FIG. 17) that fits lightly into a complimentary shaped pocket (not shown) on the support surface 216 of the shroud insert 126. As a result, the support member is lightly held by the shroud insert without being fastened thereto. In some embodiments, fastening the support member to the shroud insert may be avoided, allowing the support member to be more easily removed and replaced once a tool adapter, tool, or other structural member that traps the support member in place has been removed. In other embodiments, the support member could be fastened or otherwise be attached to the shroud insert. More discussion on how the support member may be held onto the shroud insert will be provided later herein with respect to FIGS. 28 thru 30.

The shroud insert 126 further defines a first mating feature in the form of an outer groove 232 or recess that is configured to accept a corresponding and complimentary shaped first mating feature or first projection of the shroud protector, discussed later herein. The shroud insert also defines a second mating feature in the form of a second outer groove 232' that is configured to accept a corresponding and complimentary shaped mating feature or second projection of the shroud protector, also discussed later herein. These groves are defined by thinned out regions of the throat portion 200 and are positioned between the first upper leg 208, first lower leg 210, and first support portion 214 and the inner recess 202 of the shroud insert along a lateral direction L of the shroud insert on one side, and the second upper leg 208', second lower leg 210', and second support portion 214' and the inner recess 202' of the shroud insert on the other side.

Clearance pockets 234 are found on the support portions 214 that face in the opposite direction of the support surface 216 that are configured to allow the insertion of a tool for tightening a nut 236 on a threaded shaft of a bolt 238 that extends through a clearance hole (not shown) of the support portion. The support members 134 have fastener grooves 302 with sidewalls 304 that prevent the rotation of the head of the bolt 238 from the front of the support member 134. Consequently, rotation of the nut is not imparted to the rotation of the bolt, allowing tightening of the bolt. This process may be performed twice with upper and lower fasteners to secure the support member 134 to the shroud insert 126.

The legs 208, 210 and support portions 214 also define inner guide surfaces 240 that are spaced apart a predetermined distance 242 (see FIG. 11) to provide a pathway that allows a portion of the shroud protector 102 to be inserted past the shroud insert 126 so that the shroud protector 102 may be fastened onto the lip 108. For this embodiment, little clearance is provided between these surfaces and corresponding surfaces of the legs and sides of the shroud protector, allowing load from the shroud protector to be transferred to the shroud insert and vice versa. As best seen in FIG. 13, the outside and inside surfaces 244, 246 of the legs 208, 210 also include transition regions 248 that jog, decreasing the width of the legs measured in the lateral direction L.

Figure 11:
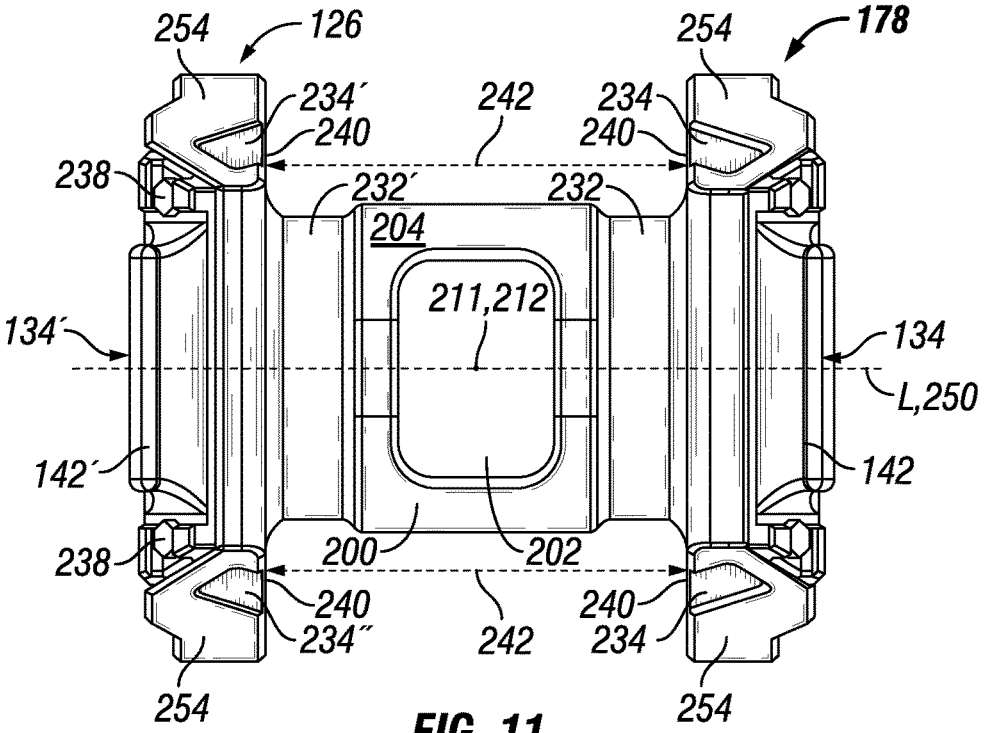
FIG. 11 is a front view of the shroud insert of FIG. 10.

The first top leg 208 may be marked "inside" and the second top leg 208' may be marked "outside", indicating how the shroud insert 126 is to be inserted onto a work implement 100. The "inside" leg is meant to be closest to the centerline C of the work implement. In FIG. 11, a single plane of symmetry 250 is shown for the shroud insert 126 of FIGS. 10 thru 13, meaning that it can be used on either side of the centerline of the work implement provided that the "inside" leg is closest to the centerline. There is a lack of symmetry with respect to the first support portion 214 and second support portion 214' of the shroud insert 126 as the first support portion 214 extends slightly further in front of the throat portion 200 than the second support portion 214' along the direction of assembly 211 as indicated by distance 252 in FIG. 13 to compensate for the curvature of the lip 108. A chamfered surface 254 is also located near each intersection of the leg 208, 210 and throat portion 200.

It is further contemplated that in other embodiments there could be two planes of symmetry for a shroud insert that straddles the centerline of the work implement. Additionally, some work implements do not have a sweep axis that is curved but is straight, defining a purely lateral direction. With such embodiments, all of the shroud inserts may have two or more planes of symmetry used on that particular work implement and their configuration may be identical.

For the embodiments shown in FIGS. 10 thru 13, the support members 134 on the left and right sides of the shroud insert assembly 178 are identical but this may not be the case for other embodiments. Also, different support members with different resilient members may be provided for different applications so that different preloads may be created, etc.

Figure 14:
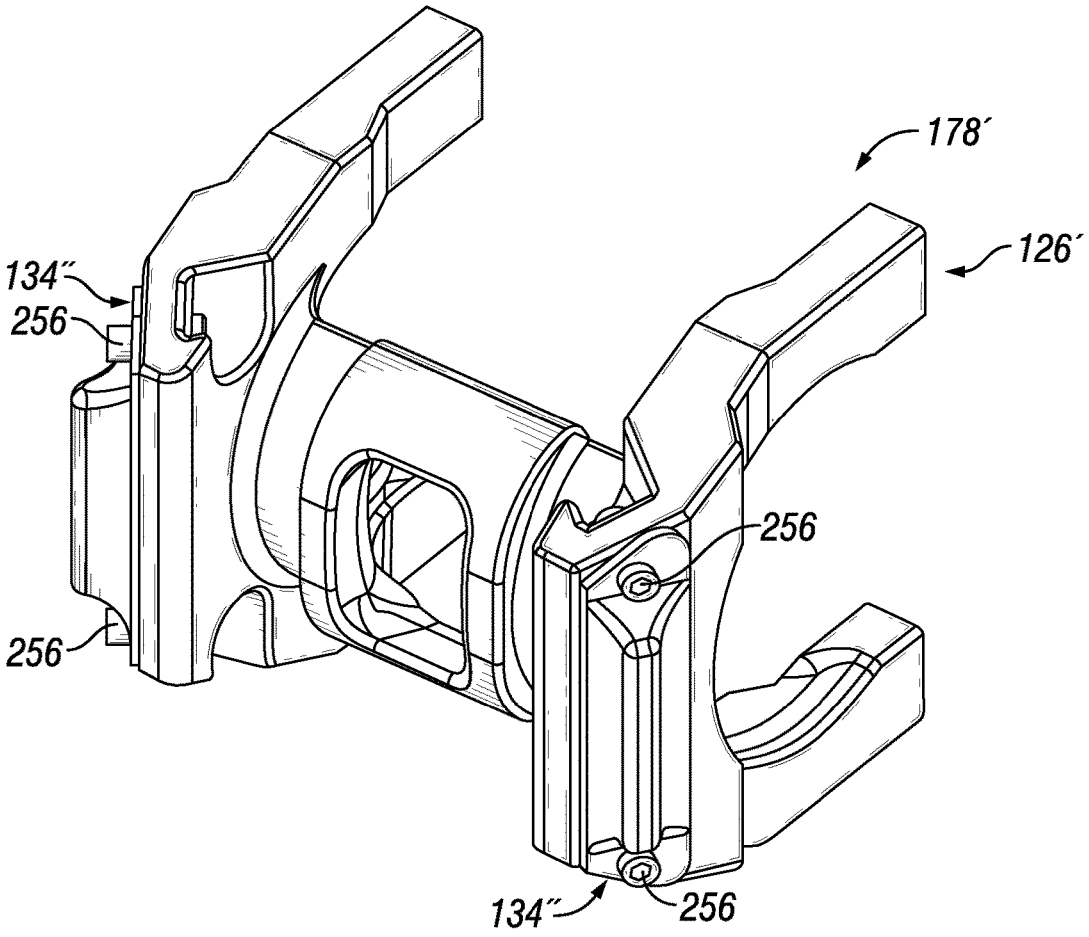
FIG. 14 is a perspective view of a shroud insert and support members that are assembled together according to another embodiment of the present disclosure.
Figure 15:
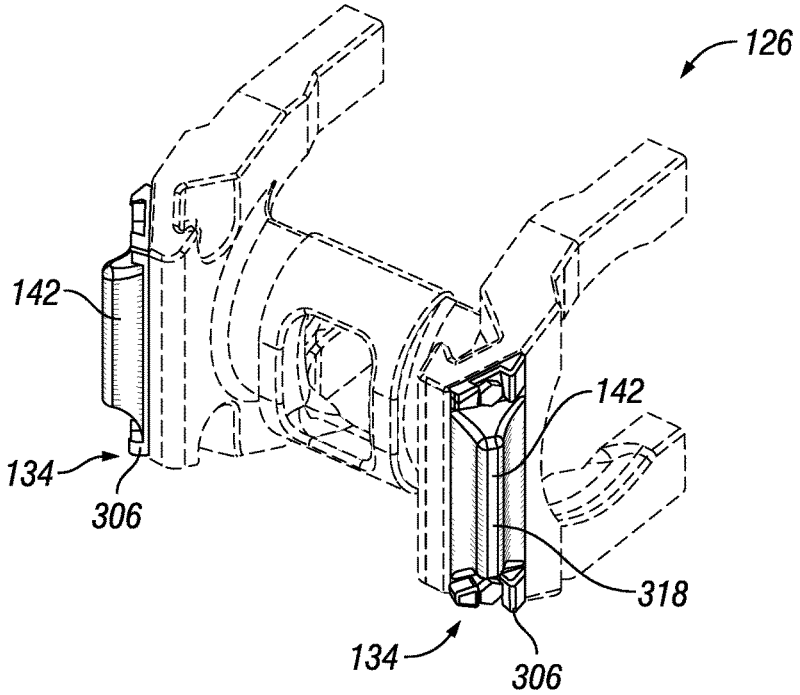
FIG. 15 is a perspective view of two support members attached to a shroud insert shown in phantom lines according to one embodiment of the present disclosure.

FIG. 14 discloses another embodiment of a shroud insert assembly 178'. This assembly is similarly configured to what has just been described with reference to FIGS. 10 thru 13 except for the following differences. The holes that were clearance holes that receive the fasteners are now threaded holes (not shown) and a cap screw 256 is provided to tighten the support member 134" onto the support surface 216 from the front of the support portion 214 instead of the rear. Hence, no nut 236 is needed in the clearance pockets 234' and no fastener grooves 302 or associated projections 300 are needed on the support member 134'.

FIGS. 15 thru 19, show an embodiment of the support member 134 according to one embodiment of the present disclosure. As mentioned previously, FIG. 15 shows that two instances of the same support member 134 may be attached to the shroud insert 126. The support member 134 includes a structural member 306 and a resilient member 142. The resilient member 142 may be adhered to the structural member 306 such as by vulcanizing it directly to the structural member. It may be snapped onto the structural member or loosely held thereto using some sort of slight interference fit between a pocket located in the structural member and a complimentary shaped projection of the resilient member or vice versa.

Figure 16:
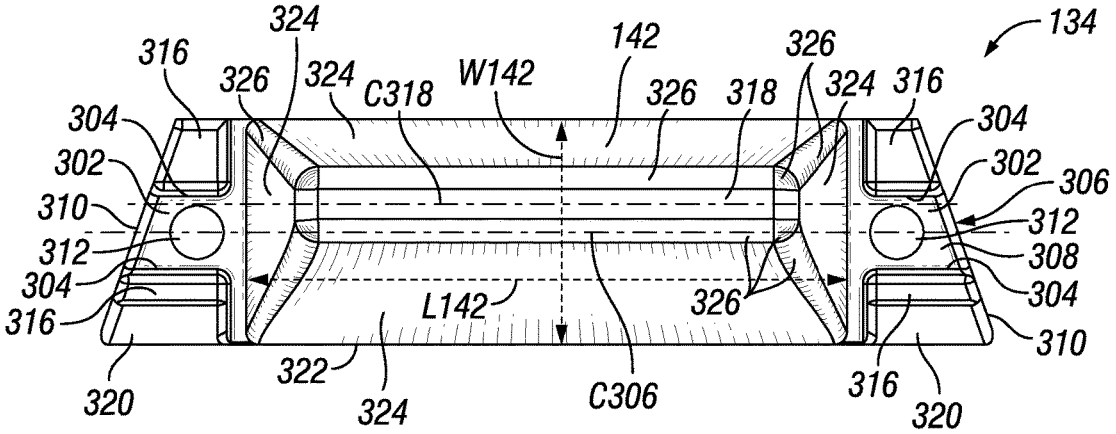
FIG. 16 is a front view of the support member of FIG. 15 showing its structural member and its resilient member more clearly.

The structural member 306 is shown in FIGS. 15 thru 19 and includes the following features as best seen in FIGS. 16 thru 19. It includes a base portion 308 that defines a substantially trapezoidal perimeter as best seen in FIG. 16. The chamfered ends 310 are configured to match the shape of the chamfered surfaces 254 of the shroud insert 126 as previously described herein. Proximate each chamfered end 310, the base portion 308 defines clearance holes 312 for receiving a fastener as also previously described herein. These clearance holes 312 as well as the rearward projection 300 define a direction of assembly 314 onto a shroud insert 126. Two projections 316 are positioned immediately adjacent either side of the clearance hole 312 that define a fastener groove 302 with sidewalls 304 that are parallel to each other that are configured to abut the faceted perimeter of a bolt, preventing the bolt from turning when tightening a nut in the clearance pockets of the shroud insert as previously described herein. These projections 316 may also limit the deflection of the resilient member 142 in use.

Figure 17:
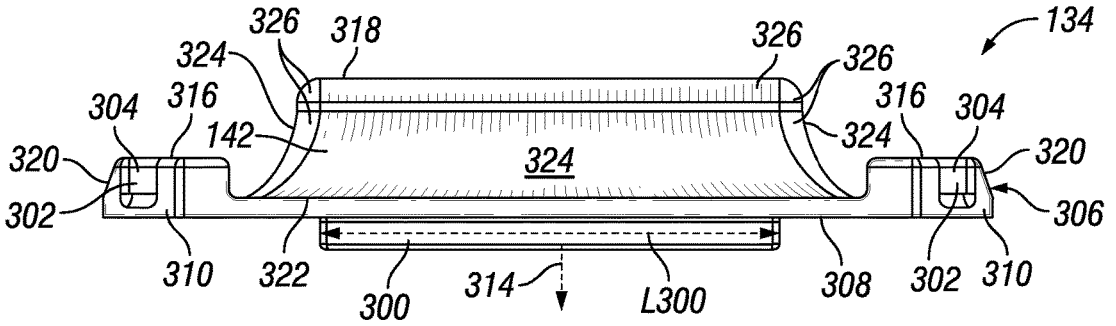
FIG. 17 is a side view of the support member of FIG. 15.
Figure 18:
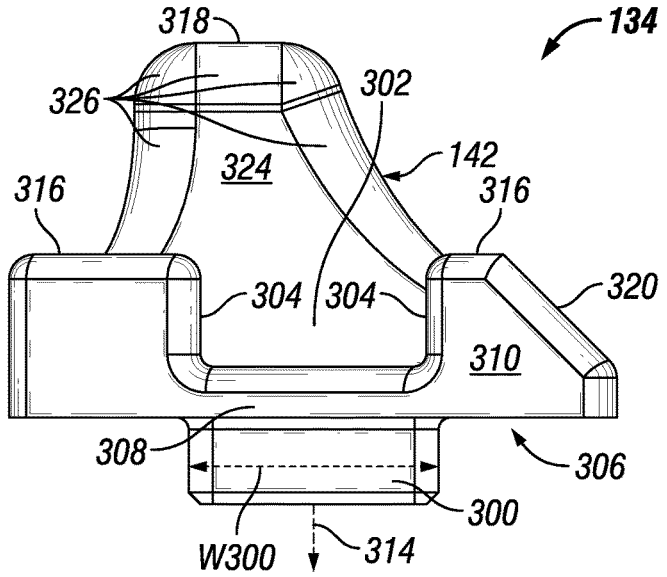
FIG. 18 is a bottom view of the support member of FIG. 15.
Figure 19:
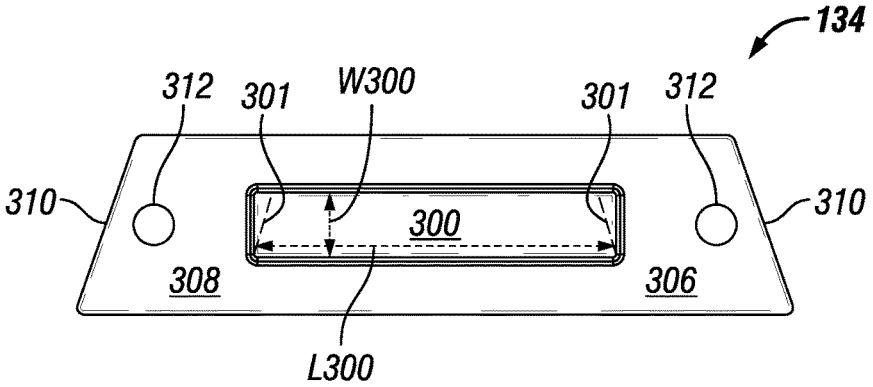
FIG. 19 is a rear view of the support member of FIG. 15.

As shown best in FIGS. 17 thru 19, a rectangular projection 300 is provided on the rear surface of the structural member 306 that may mate with a complimentary shaped pocket located on the support surface 216 of the shroud insert 126 as previously described herein. This may prevent lateral movement of the resilient member 142 relative to the shroud insert 126 in use. As shown, the projection 300 includes a length L300 and width W300 that are parallel with the length L142 and width W142 of the base of the resilient member 142 respectively. In both cases, the length exceeds the width. Also, these lengths and widths are perpendicular to each other and the direction of assembly 314. The sides of the projection 300 may be angled (see dotted lines 301 in FIG. 19) so that the profile of the projection 300 is trapezoidal instead of rectangular. Other asymmetrical features may be used that mate with a similarly configured pocket of the shroud insert to ensure proper assembly.

Focusing now on the resilient member 142 shown in FIGS. 16 thru 20, it has the following notable features. As already mentioned, the resilient member may be bonded to a steel plate or other structural member which may be bolted to the shroud insert. As best seen in FIG. 16, the resilient member 142 may have a non-symmetrical design. More specifically, the centerline C318 through the midpoint of the flat contact surface 318 of the resilient member 142 is offset relative to the centerline C306 of the structural member 306 of the support member 134 or base 308 of the resilient member. As a result, the flat contact surface 318 is further forward on the shroud insert 126 than the centerline of its base which is coextensive with the centerline C306 (see FIG. 15 as well), creating a natural bias of the resilient member 142 that resists the installation of the tool adapter 104 once the tool adapter 104 contacts the resilient member 142. Once enough preload force is exerted on the resilient member 142, the centerline C318 of the contact face may approach the centerline C306 of the of the structural member 306 of the support member 134. The structural member 306 includes a sloped surface 320 that runs parallel to these centerlines and that is positioned closer to the centerline C306 of the base than the centerline C318 of the flat contact face 318.

Also, the top of the resilient member that includes the flat contact surface 318 is not as wide as the base 322 as a predetermined radius to withstand large deformation loads narrows the resilient member 142 near the contact surface 318 as compared to its base 322. Accordingly, any side surface that connects the base to the flat contact surface may be curved as shown in FIGS. 15 thru 20. Similarly, radii 326 may be used to blend the flat contact surface 318 to the side curved surfaces 324 to minimize the presence of any straight surfaces or sharp corner. In summary, the resilient member 142 may include a base 322, a contact surface 318 that may or may not be flat, and a plurality of curved surfaces 324, 326 having various radii of curvature that join the base 322 to the contact surface 318, forming a predominantly curved set of side surfaces that are configured to avoid stress risers.

The resilient member serves two main purposes. First, it provides constant pressure between the adapters to prevent side movement of the adapter component. Without the resiliency of this component, it would be difficult to ensure constant contact between the adapter and the insert due to component tolerances. Second, the resilient member provides dampening of shock loads transferred from the adapter to the insert during side loads applied to the adapter.

Figure 20:
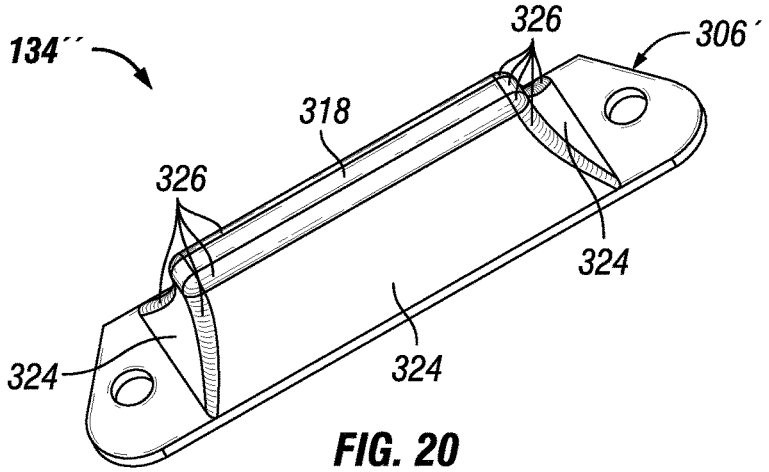
FIG. 20 is a perspective view of a support member according to another embodiment of the present disclosure showing its structural member and resilient member more clearly.

The support member 134" of FIG. 20 lacks support protrusions and fastener grooves as this embodiment of the support member is intended to be used with a fastener 256 that engages threaded holes located on the shroud insert 126' of FIG. 14. It may also lack a rear projection 300.

Different support members with different resilient members may be provided depending on the application. For example, the material and/or configurations of the resilient member may be changed depending on how much preload force is needed. The durometer or other material property may also be adjusted for similar reasons. As can be seen due to the easy access to the support member, it may be easily removed and replaced with another support member as desired, lending versatility to the embodiments of the present disclosure.

Figure 29:
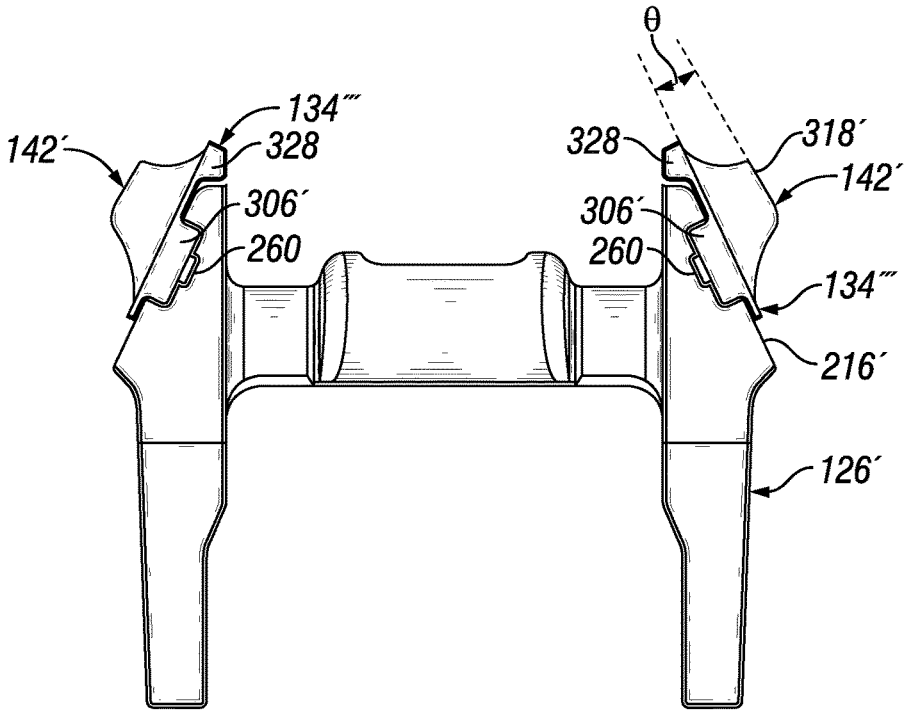
FIG. 29 depicts another embodiment of these components, showing their differences.

Indeed, FIGS. 28-36 show yet other embodiments of the shroud insert 126', support member 134'" and the resilient member 142' that show the various options available in the present disclosure. Focusing on FIG. 28, this figure illustrates that the contact face 318 of the previous version of the resilient member 142 is parallel to the support surface 216 of the shroud insert 126 (denoted by dotted lines 330) while FIG. 29 shows that the contact face 318' of the revised resilient member 142 forms an oblique angle Θ with the support surface 216' of the shroud insert 126'. In some embodiments, this angle may range from 0 to 10°. Furthermore, the revised shroud insert 216' does not have a pocket 234 for receiving a nut as the revised support member 134'" does not use a fastener to be adhered to the shroud insert 126'.

Figure 21:
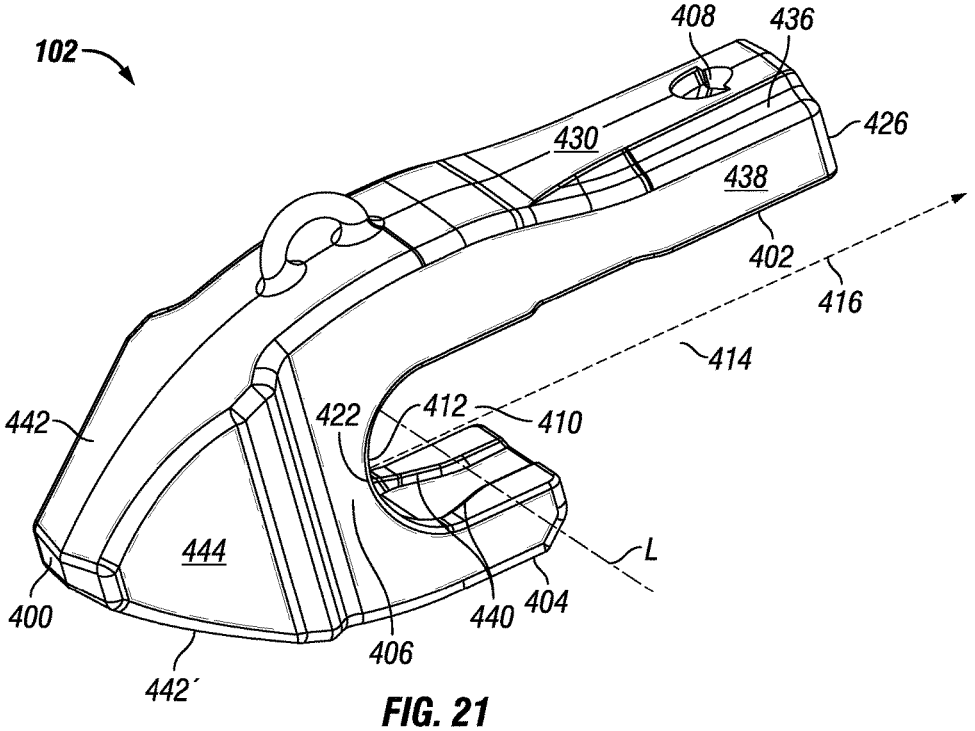
FIG. 21 is a front oriented perspective view of a shroud protector according to an embodiment of the present disclosure that includes protective features for the support members of a shroud insert.
Figure 30:
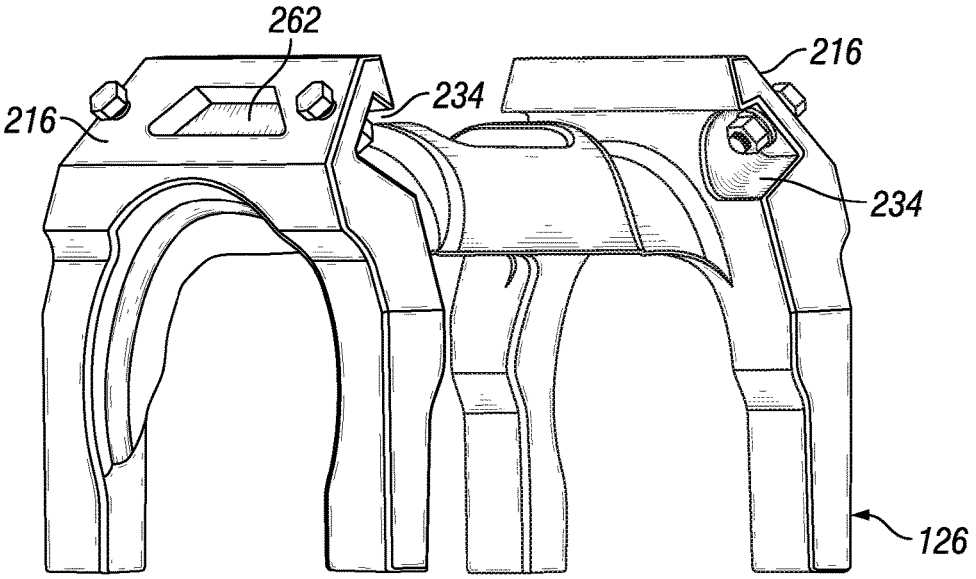
FIG. 30 is perspective view of the embodiment of FIG. 28 with the support member and the resilient member removed, revealing the pocket that receives the structural member of the support member.
Figure 31:
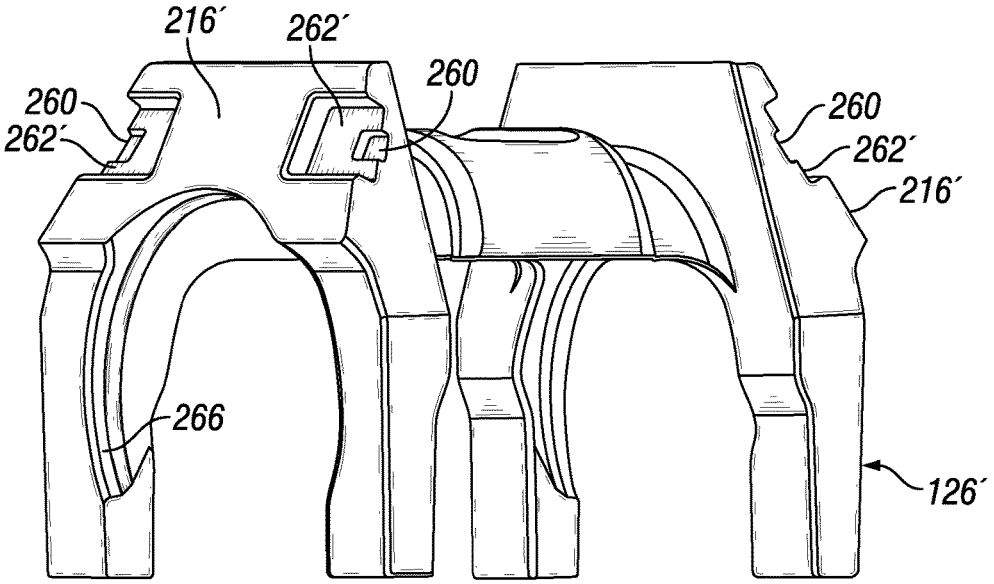
FIG. 31 is perspective view of the embodiment of FIG. 29 with the support member and the resilient member removed, revealing the pockets that receive the structural members of the support member.
Figure 32:
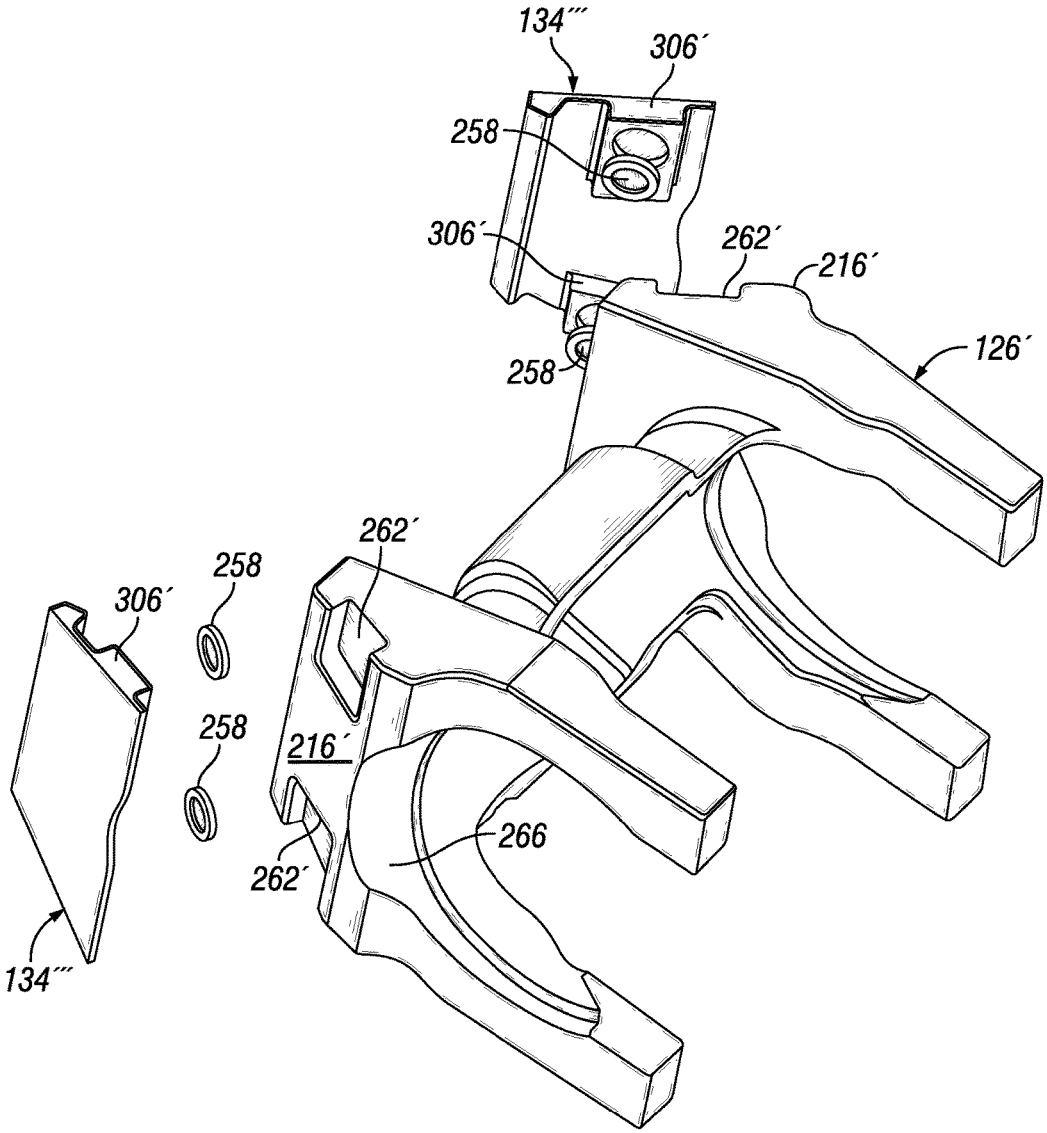
FIG. 32 is an exploded assembly view of the support member and magnets of the alternate embodiment of FIG. 29.
Figure 33:
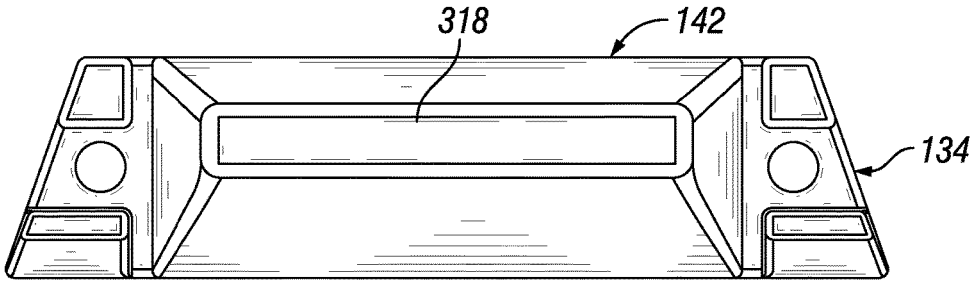
Figure 34:
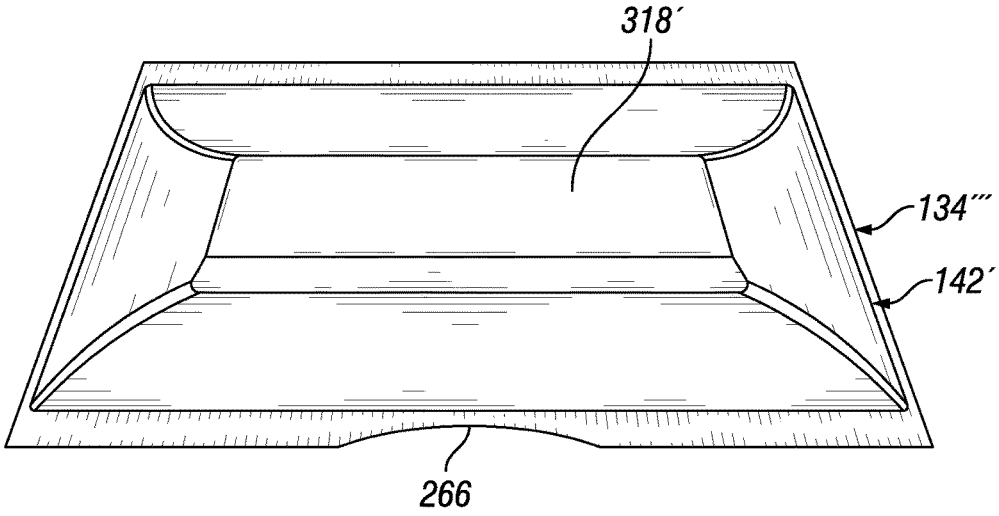
FIG. 34 is a front view of the support member and resilient member of FIG. 29.

Instead as depicted by FIGS. 29, 31 and 32, magnets 258 are used that are inserted into the structural members 306' of the support member 134'" to hold the support member 134'" onto the shroud insert 126'. Pry slots 260 adjacent pocket 262' may be provided to facilitate removal of the support member 134'" from the shroud insert 126'. As best seen in FIGS. 30, 21 and 32, the various pockets 262, 262' of the shroud insert 126, 126' may be complimentary configured to receive the structural members 306, 306' of the support member 134, 134'". For the embodiment in FIG. 30, the pocket 262 is completely bound or surrounded by the support surface 216 and includes a trapezoidal configuration. For the revised embodiment in FIG. 31, two pockets 262' are positioned at the top and bottom of the support surface 216' of the shroud insert 126' adjacent an edge of the support surface 216'. As mentioned earlier, asymmetrical features such as asymmetrical pockets may be used to foolproof the assembly of the support member to the shroud insert. Alternatively, as best seen in FIG. 29, a forward protrusion 328 may be provided that protects the front portion of the casting of the shroud insert 126' and will interfere with the support surface 216' of the shroud insert 126' if improperly reversed, fool proofing the assembly of the support member 134'" onto the shroud insert 126'.

Figure 35:
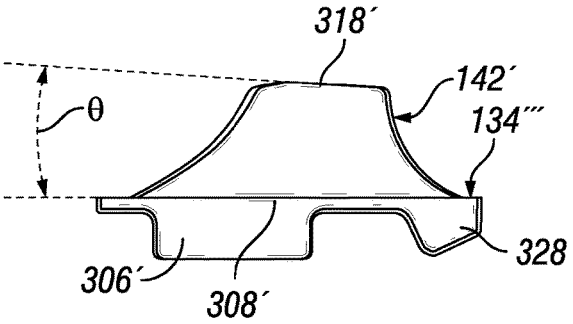
Figure 36:
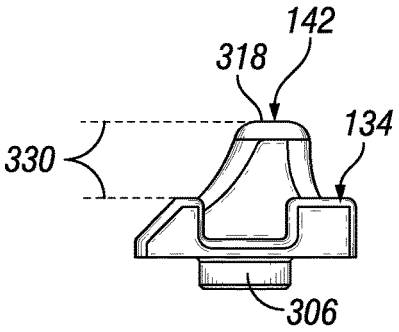
FIG. 36 is a top view of the support member and resilient member of FIG. 33.

Referring to FIGS. 33 thru 36, it can be seen that the revised support member 134'" and revised resilient member 142' have the following differences when compared to the previous support member 134 and resilient member 142. The revised support member 134'" and revised resilient member 142' are wider and longer than the embodiments previously discussed and the contact face 318' is enlarged. As a result, part of the clearance surface 266 that is on the shroud insert 126' is also on the revised support member 134'". Also as mentioned earlier, there is an oblique angle Θ formed by the contact surface 318' and the base 308' of the support member 134'" for the revised embodiments. Both embodiments of the resilient member 142, 142' have an asymmetrical profile as shown in FIGS. 35 and 36, it is contemplated that this might not be the case for other embodiments.

It is to be understood that other than the differences just discussed with respect to the revised embodiments of the shroud insert, support member and resilient member of FIGS. 28 thru 36, that the revised embodiments are similarly configured as those shown and described in FIGS. 10 thru 20.

Figure 22:
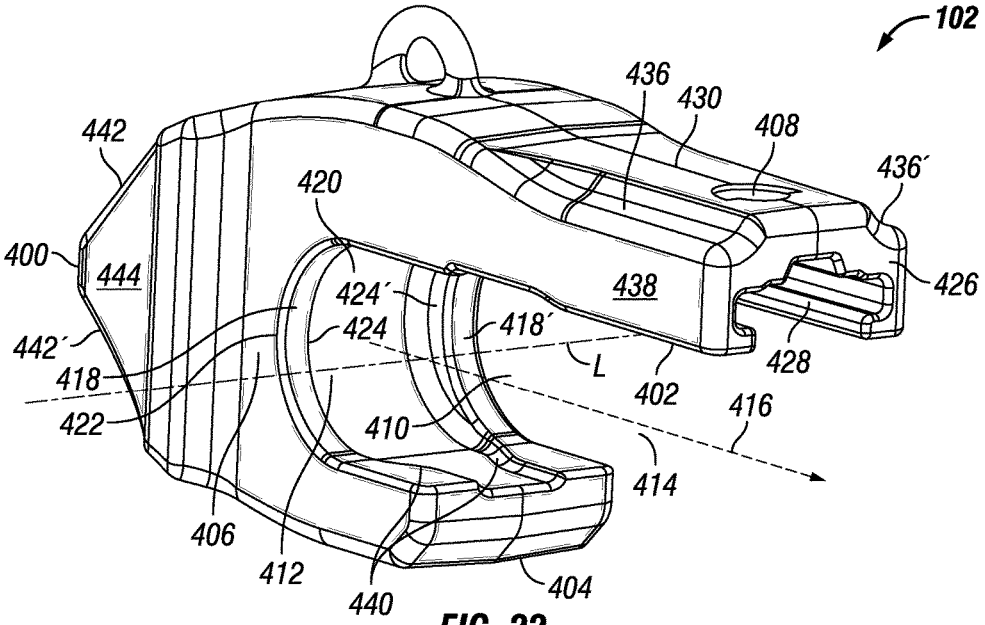
FIG. 22 is a rear oriented perspective view of the shroud protector of FIG. 21.

Looking now at FIGS. 21 thru 24, a shroud protector 102 is disclosed for use with a support assembly for ground engaging tools and that is configured to be attached to a work implement using a retaining mechanism. This shroud protector 102 may be used with the other components described herein thus far. The shroud protector 102 comprises a nose portion 400, a first leg 402, a second leg 404, a throat portion 406 that connects the legs 402, 404 and nose portion 400 together, and at least one leg that defines an aperture 408 that is configured to receive a retaining mechanism. The first and second legs 402, 404 define a slot 410 that may include a closed end 412 and an open end 414 (best seen in FIG. 23), the slot 410 defining a direction 416 of assembly onto a work implement. In addition as best seen in FIG. 22, the shroud protector 102 may comprise at least one projection 418 that is configured to be a mating feature and that partially defines a clearance pocket 420.

Similarly, the shroud protector 102 may further comprise a second projection 418' that is configured to be a mating feature and that partially defines the clearance pocket 420. The first and second the projections 418, 418' may comprise outside abutment surfaces 422, 422'that are configured to contact mating features of another component of the support assembly such as the shroud insert. The projections 418, 418' may comprise inside clearance surfaces 424, 424' adjacent the clearance pocket 420 that do not contact the lip protrusion 114 or mating features of the shroud insert 126 as shown in FIGS. 5 and 9 and described earlier herein.

Figure 23:
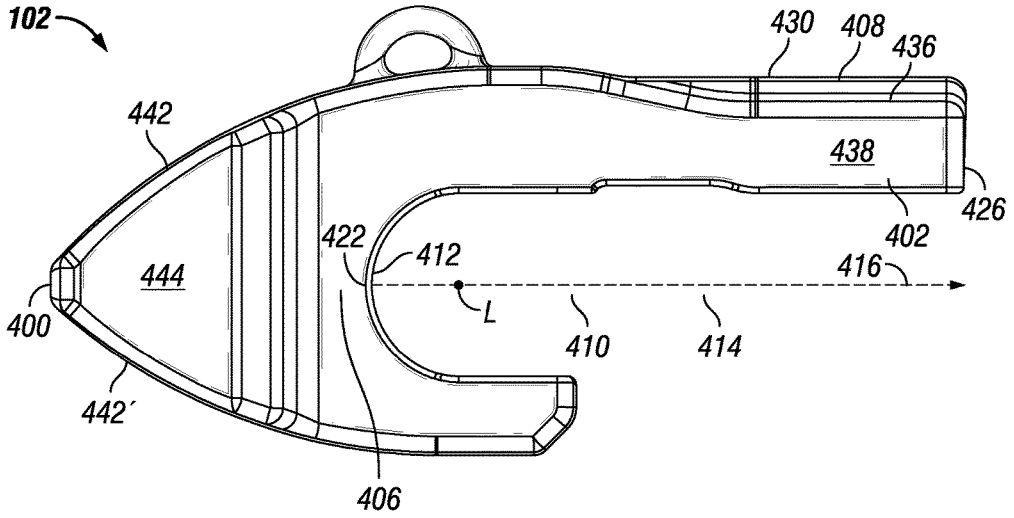
FIG. 23 is a side view of the shroud protector of FIG. 21.

FIGS. 21 thru 23 also show that the first leg 402 may be longer than the second leg 404 in the direction of assembly 416. In this embodiment, the first leg is the top leg 402 that includes a rear surface 426 that defines a slot 428 that is configured to receive a locking member (not shown) that protrudes from the top surface of the front lip. Also, the top leg 402 includes a top surface 430 that defines the aperture 408 for receiving the retaining mechanism 130 as previously described with reference to FIG. 7.

Figure 24:
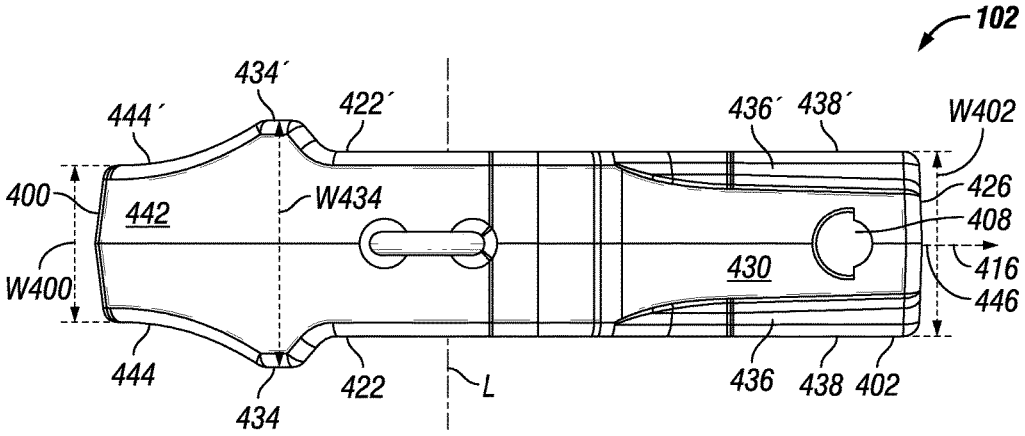
FIG. 24 is a top view of the shroud protector of FIG. 21.

As shown in FIGS. 21 thru 24, the slot 410 also defines a lateral direction L that is perpendicular to the direction of assembly 416. As best seen in FIG. 24, the shroud protector 102 defines a width measured in the lateral direction L, wherein the width W400 of the nose portion 400 increases until this width reaches a maximum W434 at a positioned disposed forward of the slot 410 along the direction of assembly 416. The width narrows rearward of the maximum width W434 along the direction of assembly 416 and this change in width creates protrusions 434 that are configured to shield a component of the support assembly. For example as shown in FIGS. 5 and 9, the protrusions 434 may act as a protective feature for the resilient member 142. The width W400 of the front portion of the nose 400 may be substantially the same as the width W402 of the rear portion of the upper leg 402, which may match that of the lower leg 404.

FIGS. 21 thru 23 best show that the entire protrusion 434 is positioned forward of the slot 410 along the direction of assembly 416. This may not be the case for other embodiments. Other features of the shroud protector 102 include chamfered surfaces 436 that connect the top and side surfaces 430, 438 of the top leg 402. Also, the clearance pocket 420 is shown to narrow as it transitions (pointed out by reference numeral 440) into the lower leg 404. Similar geometry may be present with respect to how the clearance pocket transitions to the upper leg (not shown). The nose portion 400 may include convexly curved upper and lower surfaces 442 and concavely curved side surfaces 444 as best seen in FIGS. 23 and 24 respectively. A plane of symmetry 446 for the shroud protector 102 is shown in FIG. 24.

Figure 25:
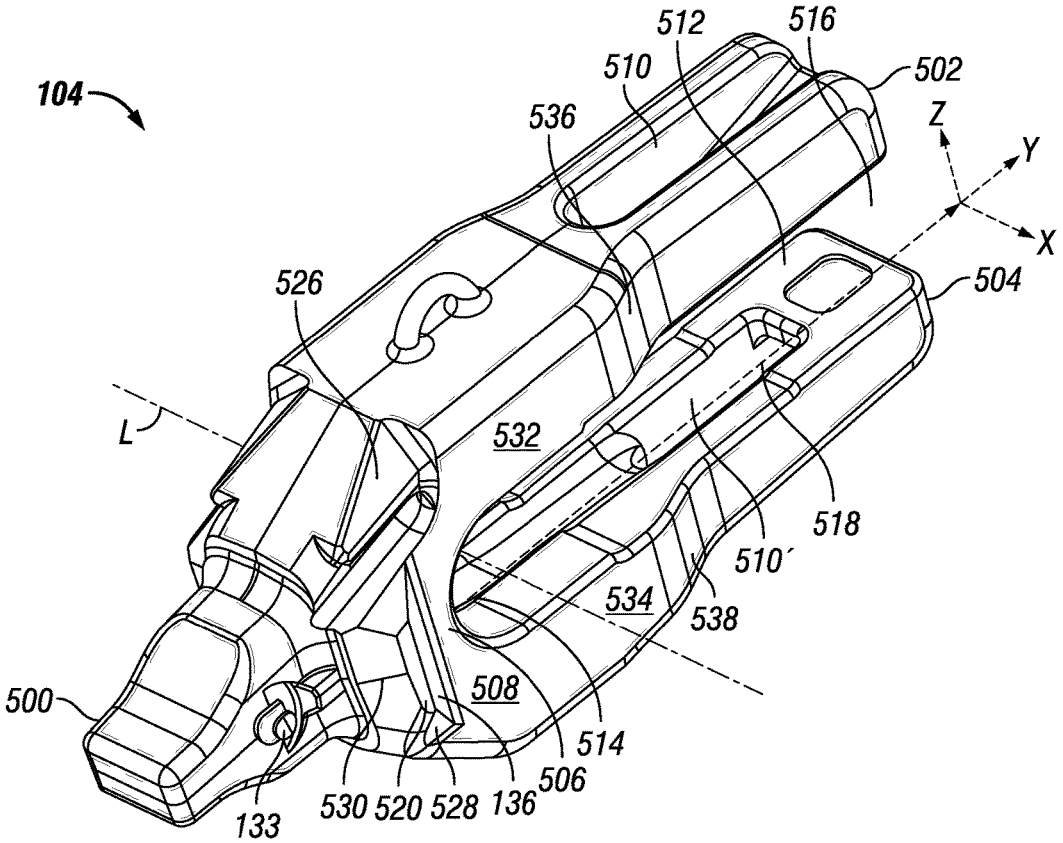
FIG. 25 is a perspective view of a tool adapter that includes a projection with a reinforcement surface that is configured to contact the support member according to one embodiment of the present disclosure.
Figure 26:
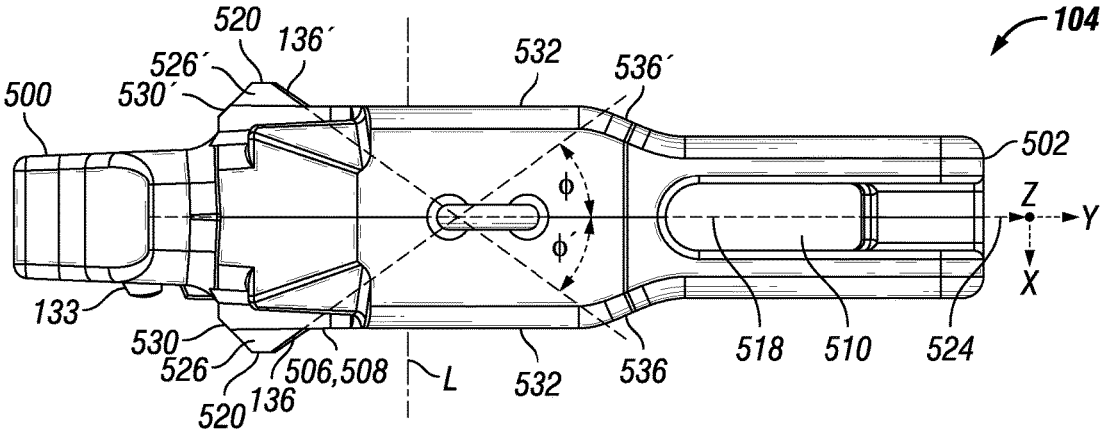
FIG. 26 is a top view of the tool adapter of FIG. 25.
Figure 27:
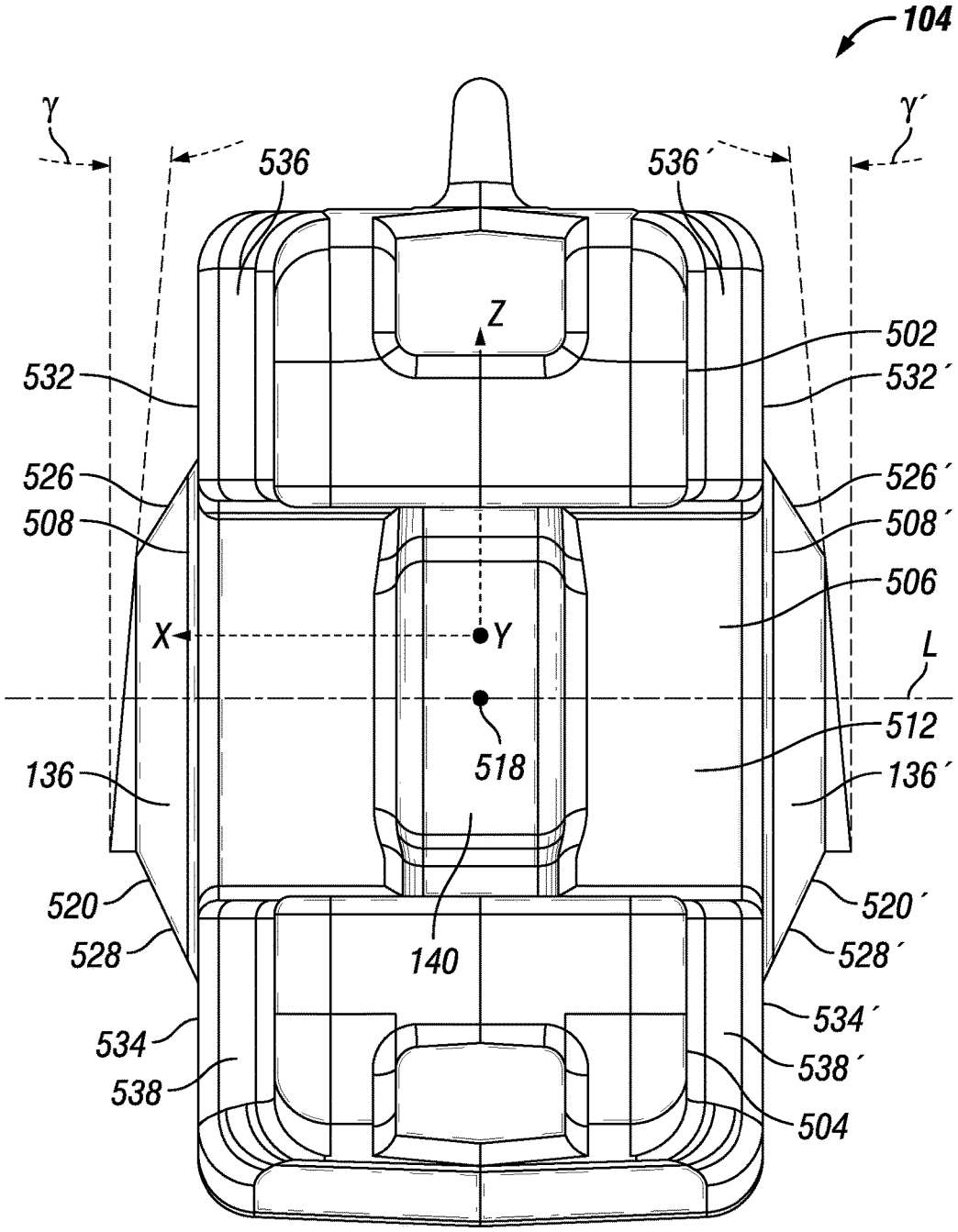
FIG. 27 is a rear view of the tool adapter of FIG. 25.

Turning now to FIGS. 25 thru 27, a tool adapter 104 for attaching a tool to a work implement using a retaining mechanism and for use with a support assembly for ground engaging tools is illustrated. The tool adapter 104 comprises a nose portion 500 that is configured to facilitate the attachment of a tool, a first leg 502, a second leg 504, a throat portion 506 that connects the legs 502, 504 and nose portion 500 together and that includes a side surface 508, and at least one leg that defines an aperture 510 that is configured to receive a retaining mechanism (see 172 in FIG. 8).

The first and second legs 502, 504 and throat portion 506 may define a slot 512 that includes a closed end 514 and an open end 516 as best seen in FIG. 25, the slot 512 defining a direction of assembly 518 onto a work implement, and at least one projection 520 that includes a reinforcement surface 136 positioned in front of the slot 512 along the direction of assembly 518 that extends from the side surface 508 of the throat portion 506. The throat portion 506 may further include a second side surface 508' and the tool adapter 104 may further comprise a second projection 520' that extends from the second side surface 508' and that is opposite the first projection 520 and is similarly configured. In fact as best seen in FIG. 26, the tool adapter 104 is symmetrical about a plane 524 through the direction of assembly 518.

The reinforcement surface 136 forms an oblique included angle φ with the direction of assembly 518. The slot 512 further defines a lateral direction L and the tool adapter 104 defines Cartesian coordinates where the Y axis is aligned with the direction of assembly 518 and the X direction is parallel with the lateral direction L. The oblique angle φ may be in the X-Y plane and may range from 20 to 40 degrees as best seen in FIG. 26. More particularly, the angle φ may range from 25 to 35 degrees. Alternatively or in addition to this, an oblique angle γ may exist between the surface 136 and the Z direction in the X-Z plane and ranges from 0 to 10 degrees as best seen in FIG. 27. More particularly, this angle γ may range from 0 to 5 degrees. This angle γ compensates for the curvature of the sweep axis S of the front lip 108 as shown in FIG. 3.

Furthermore, the projection 520 may include top and bottom chamfered surfaces 526, 528 and a front chamfered surface 530. The side surfaces 532, 534 of the legs 502, 504 may jog or transition 536, 538 to narrow the legs toward the rear of the slot 512 along the direction of assembly 518. Other angles are possible and the jogging of the legs may be omitted in other embodiments. The nose portion 500 also includes a boss 133 used to attach a tool 106 as previously described with reference to FIG. 5. Recess 140 is also shown in FIG. 27 that receives the lip protrusion 114 in a manner previously described with reference to FIG. 5.

INDUSTRIAL APPLICABILITY

In practice, a work implement such as a bucket may be sold with a support assembly for ground engaging tools according to any of the embodiments discussed herein. In other situations, a kit that includes components for retrofitting an existing work implement or a newly bought work implement with a support assembly may be provided. With reference to FIGS. 5 and 9, the support assembly 600 may include the working edge 108, shroud insert 126, shroud protector 102 and tool adapter 104. Fewer components may be necessary when one or more components are combined with each other. For example, one component that includes both the tool 106 and a tool adapter 104 in the form of a tool attachment portion that is integral with the tool and another component that includes the shroud protector 102, shroud insert 126 and the support member 134 integrated into a single component may be all that is needed in other embodiments. Accordingly, the term tool adapter should be interpreted broadly to include an attachment portion of a tool that is directly connected to a working edge and the term support member should include any member that provides a support function to an adjacent component, regardless of what other functions it provides.

A kit 602 for supplying components for a support assembly for ground engaging tools may be sold or otherwise be made available to the end user as illustrated by FIG. 9. The kit 602 may comprise a shroud protector 102 for use with a support assembly 600 for ground engaging tools and that is configured to be attached to a work implement 100 using a retaining mechanism. The shroud protector 102 may include at least one projection 152 that is configured to be a mating feature and that partially defines a clearance pocket 138, both of which have been previously discussed. The kit 602 may further comprise a tool adapter 104 for attaching a tool 106 to a work implement using a retaining mechanism and for use with a support assembly 600 for ground engaging tools that includes (as best seen in FIG. 26) at least one projection 520 that includes a reinforcement surface 136 and (as best seen in FIG. 10) a shroud insert 126 that includes a resilient member 142 that is configured to engage the reinforcement surface 136 of the tool adapter 104.

This shroud insert 126 may include a separate support member 134 that is configured to be attached and detached from the shroud insert 126 and that includes the resilient member 142. The kit 602 may further comprise a second support member 134'. The first and second support members may have the same or different configurations. The shroud insert may include a mating feature that is configured to engage a mating feature of the shroud protector.

Mating features discussed herein may take any form known or that will be devised in the art. A female mating feature on one component may have a corresponding male feature on another component. These features may be swapped relative to each other and their associated components.

Once the necessary components of the kit 602 have been obtained, the support assembly 600 may be created or assembled per the following method 700 as illustrated by FIGS. 6 thru 9. During installation as indicated by FIGS. 6 and 7, the insert casting 126 is installed (step 166 of FIG. 6) onto the lip shroud positions of the lip casting until the protrusions 114 are in the inner recess 138 of the insert 126 prior to installing the adapters 104. The lip shrouds or shroud protectors 102 are then installed and secured into place (step 168 of FIG. 7).

Next as shown by FIG. 8, the adapters 104 are seated into the adapter positions until the adapter 104 makes contact with one of the resilient members 142 of the insert 126 (step 170). The adapter retention system or retaining mechanism 172 will then be installed and tightened (step 174). This tightening will compress the resilient members on the inserts and center the location of the adapter onto the adapter lip position using the protrusions 114. The adapter will stop moving when it makes contact with the lip casting radius or front edge 116. Step 174 may be performed before step 168 in certain embodiments, trapping the shroud insert onto the working edge without needing the shroud protector.

As depicted by FIG. 9, when all the adapters 104 are installed, the resilient members 142 on the insert 126 are all compressed thus tying all the adapter and inserts together, forming the load path 128 (step 176).

It will be appreciated that the foregoing description provides examples of the disclosed assembly and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. Also, the numbers recited are also part of the range.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps or combined. Furthermore, variations or modifications to certain aspects or features of various embodiments may be made to create further embodiments and features and aspects of various embodiments may be added to or substituted for other features or aspects of other embodiments in order to provide still further embodiments.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A shroud insert assembly for use with a support assembly for ground engaging tools, the shroud insert assembly comprising:

a shroud insert comprising:

a throat portion that defines a recess that defines a longitudinal axis and a direction of assembly for the shroud insert that are coextensive;

a front and a rear disposed along the direction of assembly;

a first upper leg;

a first lower leg; and a first support portion that includes a support surface that defines a surface normal pointing toward the front of the shroud insert along the direction of assembly that forms an oblique angle with the direction of assembly; and a support member that is attached to the support surface comprising:

a resilient member.

2. The shroud insert assembly of claim 1 wherein the resilient member includes at least one of the following: a rubber, a polyurethane, a closed-cell foam, and a spring.

3. A shroud insert for use with a support assembly for ground engaging tools, the shroud insert comprising:

a throat portion that defines a recess that defines a longitudinal axis and a direction of assembly for the shroud insert that are coextensive;

a front and a rear disposed along the direction of assembly;

a first upper leg;

a first lower leg; and a first support portion that includes a support surface that defines a surface normal pointing toward the front of the shroud insert along the direction of assembly that forms an oblique angle with the direction of assembly; and wherein the throat portion includes a curved configuration that defines a lateral direction and the recess is an inner recess that is centered laterally along the lateral direction and the throat portion further defines an outer recess that is positioned between the support portion and the center recess along the lateral direction.

4. The shroud insert of claim 3, wherein at least a portion of the support surface is positioned forward of the throat portion along the direction of assembly and the legs extend from the throat portion in a rearward direction along the direction of assembly.

5. The shroud insert of claim 3, wherein the oblique angle ranges from 110-160 degrees.

6. The shroud insert of claim 3 further comprising:

a second upper leg; and a second lower leg;

wherein the first upper leg and second upper leg define a pathway for the insertion of a portion of a shroud protector and the first lower leg and second lower leg define another pathway for the insertion of a portion of a shroud protector.

7. The shroud insert of claim 6, wherein the legs each include a curved surface that is configured to match the contour of a working edge of a work implement.

8. The shroud insert of claim 7, wherein the legs each further includes an angled surface that is adjacent the curved surface.

9. The shroud insert of claim 3 further comprising a second support portion that includes a support surface that defines a surface normal pointing toward the front of the shroud insert along the direction of assembly that forms an oblique angle with the direction of assembly.

10. The shroud insert of claim 9, wherein the first support portion is more forward of the throat portion along the direction of assembly than the second support portion.

11. The shroud insert of claim 3, wherein the support surface defines at least one pocket.

12. The shroud insert of claim 11, wherein the pocket is completely bound by the support surface and includes a trapezoidal configuration.

13. The shroud insert of claim 11, wherein the pocket is adjacent an edge of the support surface and includes a rectangular configuration.

14. The shroud insert of claim 13, wherein the pocket defines a pry slot adjacent the pocket, the pry slot having a different depth than the pocket.

* * * * *